US010676923B2

(12) United States Patent
Collins et al.

(10) Patent No.: US 10,676,923 B2
(45) Date of Patent: Jun. 9, 2020

(54) WATERPROOFING ASSEMBLIES AND PREFABRICATED WALL PANELS INCLUDING THE SAME

(71) Applicant: Innovative Building Technologies, LLC, Seattle, WA (US)

(72) Inventors: Arlan Collins, Seattle, WA (US); Mark Woerman, Seattle, WA (US)

(73) Assignee: Innovative Building Technologies, LLC, Seattle, WA (US)

( * ) Notice: Subject to any disclaimer, the term of this patent is extended or adjusted under 35 U.S.C. 154(b) by 0 days.

(21) Appl. No.: 16/082,863

(22) PCT Filed: Mar. 7, 2017

(86) PCT No.: PCT/US2017/021177
§ 371 (c)(1),
(2) Date: Sep. 6, 2018

(87) PCT Pub. No.: WO2017/156014
PCT Pub. Date: Sep. 14, 2017

(65) Prior Publication Data

US 2019/0100911 A1 Apr. 4, 2019

Related U.S. Application Data

(60) Provisional application No. 62/304,858, filed on Mar. 7, 2016.

(51) Int. Cl.
*E04B 2/74* (2006.01)
*E04B 2/90* (2006.01)
(Continued)

(52) U.S. Cl.
CPC ..... *E04B 2/7448* (2013.01); *E04B 1/34321* (2013.01); *E04B 1/665* (2013.01);
(Continued)

(58) Field of Classification Search
CPC .. E04B 1/34321; E04B 1/34384; E04B 1/348; E04B 1/66; E04B 1/665; E04B 1/68; E04B 1/6815; E04B 2/7448; E04B 2/90
See application file for complete search history.

(56) References Cited

U.S. PATENT DOCUMENTS 1,168,556 A 1/1916 Robinson et al.
1,501,288 A 7/1924 Morley
(Continued)

FOREIGN PATENT DOCUMENTS

AU 2005200682 5/2005
AU 2012211472 2/2014
(Continued)

OTHER PUBLICATIONS

US 8,701,371 B2, 04/2014, Collins et al. (withdrawn)
(Continued)

*Primary Examiner* — Christine T Cajilig

(57) ABSTRACT

Wall panels and methods of constructing a wall system for a building are described. In some embodiments, a pre-assembled wall panel may include a panel frame including a perimeter member defining a perimeter side of the panel frame, first and second wall boards attached to opposite sides of the panel frame to define first and second major sides of the wall panel, each of the first and second wall boards comprising non-combustible material, and a waterproofing assembly enclosing the perimeter side of the panel frame and extending along a full length of the perimeter side, wherein the waterproofing assembly includes a non-metallic elongate member comprising first and second opposing flanges disposed against respective exterior surfaces of the first and second wall boards, and wherein the first and second opposing flanges are attached to the perimeter member.

34 Claims, 14 Drawing Sheets

(51) Int. Cl.

| | |
|---|---|
| ***E04B 1/343*** | (2006.01) |
| ***E04B 1/66*** | (2006.01) |
| ***E04B 1/88*** | (2006.01) |
| ***E04B 1/24*** | (2006.01) |
| ***E04B 1/74*** | (2006.01) |

(52) U.S. Cl.

CPC ..... *E04B 1/88* (2013.01); *E04B 2/90* (2013.01); *E04B 1/24* (2013.01); *E04B 1/74* (2013.01)

(56) References Cited

U.S. PATENT DOCUMENTS 1,876,528 A 7/1931 Walters
1,883,376 A 10/1932 George et al.
2,160,161 A 5/1939 Marsh
2,419,319 A 4/1947 Lankton
2,495,862 A 1/1950 Osborn
2,562,050 A 7/1951 Lankton
2,686,420 A 8/1954 Youtz
2,722,724 A 11/1955 Wallace
2,758,467 A 8/1956 Brown et al.
2,871,544 A 2/1959 Youtz
2,871,997 A 2/1959 Simpson et al.
2,877,990 A 3/1959 Goemann
2,946,413 A 7/1960 Weismann
3,017,723 A 1/1962 Von Heidenstam
3,052,449 A 9/1962 Long et al.
3,053,015 A 9/1962 George
3,053,509 A 9/1962 Haupt et al.
3,065,575 A 11/1962 Ray
3,079,652 A 3/1963 Wahlfeld
3,184,893 A 5/1965 Booth
3,221,454 A 12/1965 Giulio
3,235,917 A 2/1966 Skubic
3,236,014 A 2/1966 Edgar
3,245,183 A 4/1966 Tessin
3,281,172 A 10/1966 Kuehl
3,315,424 A 4/1967 Smith
3,355,853 A 12/1967 Wallace
3,376,919 A 4/1968 Agostino
3,388,512 A 6/1968 Newman
3,392,497 A 7/1968 Vantine
3,411,252 A 11/1968 Boyle, Jr.
3,460,302 A 8/1969 Cooper
3,490,191 A 1/1970 Ekblom
3,568,380 A 3/1971 Stucky et al.
3,579,935 A 5/1971 Regan et al.
3,590,393 A 7/1971 Hollander
3,594,965 A 7/1971 Saether
3,604,174 A 9/1971 Nelson, Jr.
3,608,258 A 9/1971 Spratt
3,614,803 A 10/1971 Matthews
3,638,380 A 2/1972 Perri
3,707,165 A 12/1972 Stahl
3,713,265 A 1/1973 Wysocki et al.
3,721,056 A 3/1973 Toan
3,722,169 A 3/1973 Boehmig
3,727,753 A 4/1973 Starr
3,742,666 A 7/1973 Antoniou
3,750,366 A 8/1973 Rich, Jr. et al.
3,751,864 A 8/1973 Berger et al.
3,755,974 A 9/1973 Berman
3,762,115 A 10/1973 McCaul, III
3,766,574 A 10/1973 Smid, Jr.
3,821,818 A 7/1974 Alosi
3,823,520 A 7/1974 Ohta et al.
3,845,601 A 11/1974 Kostecky
3,853,452 A 12/1974 Delmonte
3,885,367 A 5/1975 Thunberg
3,906,686 A 9/1975 Dillon
3,921,362 A 11/1975 Ortega
3,926,486 A 12/1975 Sasnett
3,971,605 A 7/1976 Sasnett
3,974,618 A 8/1976 Cortina
3,990,202 A 11/1976 Becker
4,018,020 A 4/1977 Sauer et al.
4,038,796 A 8/1977 Eckel
4,050,215 A 9/1977 Fisher
4,059,936 A 11/1977 Lukens
4,065,905 A 1/1978 Lely et al.
4,078,345 A 3/1978 Piazzalunga
4,107,886 A 8/1978 Ray
4,112,173 A 9/1978 Roudebush
4,114,335 A 9/1978 Carroll
4,142,255 A 3/1979 Togni
4,161,087 A 7/1979 Levesque
4,171,545 A 10/1979 Kann
4,176,504 A 12/1979 Huggins
4,178,343 A 12/1979 Rojo, Jr.
4,205,719 A 6/1980 Norell et al.
4,206,162 A 6/1980 Vanderklaauw
4,214,413 A 7/1980 Gonzalez Espinosa de Los Monteros
4,221,441 A 9/1980 Bain
4,226,061 A 10/1980 Day, Jr.
4,248,020 A 2/1981 Zielinski et al.
4,251,974 A 2/1981 Vanderklaauw
4,280,307 A 7/1981 Griffin
4,314,430 A 2/1982 Farrington
4,325,205 A 4/1982 Salim
4,327,529 A 5/1982 Bigelow, Jr.
4,341,052 A 7/1982 Douglass, Jr.
4,361,994 A 12/1982 Carver
4,389,831 A 6/1983 Baumann
4,397,127 A 8/1983 Mieyal
4,435,927 A 3/1984 Umezu
4,441,286 A 4/1984 Skvaril
4,447,987 A 5/1984 Lesosky
4,447,996 A 5/1984 Maurer, Jr.
4,477,934 A 10/1984 Salminen
4,507,901 A 4/1985 Carroll
4,513,545 A 4/1985 Hopkins, Jr.
4,528,793 A 7/1985 Johnson
4,531,336 A * 7/1985 Gartner ..... E04B 2/90 49/DIG. 1
4,592,175 A 6/1986 Werner
4,646,495 A 3/1987 Chalik
4,648,228 A 3/1987 Kiselewski
4,655,011 A 4/1987 Borges
4,688,750 A 8/1987 Teague et al.
4,712,352 A 12/1987 Low
4,757,663 A 7/1988 Kuhr
4,856,244 A 8/1989 Clapp
4,862,663 A 9/1989 Krieger
4,893,435 A 1/1990 Shalit
4,910,932 A 3/1990 Honigman
4,918,897 A 4/1990 Luedtke
4,919,164 A 4/1990 Barenburg
4,974,366 A 12/1990 Tizzoni
4,991,368 A 2/1991 Amstutz
5,009,043 A 4/1991 Kurrasch
5,010,690 A 4/1991 Geoffrey
5,036,638 A * 8/1991 Kurtz, Jr. ..... E04B 1/14 52/264
5,076,310 A 12/1991 Barenburg
5,079,890 A 1/1992 Kubik et al.
5,127,203 A 7/1992 Paquette
5,127,760 A 7/1992 Brady
5,154,029 A * 10/1992 Sturgeon ..... E04F 13/12 52/235
5,185,971 A 2/1993 Johnson, Jr.
5,205,091 A 4/1993 Brown
5,212,921 A 5/1993 Unruh
5,228,254 A 7/1993 Honeycutt, Jr.
5,233,810 A 8/1993 Jennings
5,254,203 A 10/1993 Corston
5,307,600 A 5/1994 Simon, Jr.
5,359,820 A 11/1994 McKay
5,361,556 A 11/1994 Menchetti
5,402,612 A 4/1995 diGirolamo et al.
5,412,913 A 5/1995 Daniels et al.
5,426,894 A 6/1995 Headrick

(56) References Cited

U.S. PATENT DOCUMENTS 5,452,552 A * 9/1995 Ting ..... E06B 7/14 52/235
5,459,966 A 10/1995 Suarez
5,471,804 A 12/1995 Winter, IV
5,483,773 A 1/1996 Parisien
5,493,838 A 2/1996 Ross
5,509,242 A 4/1996 Rechsteiner et al.
5,519,971 A 5/1996 Ramirez
5,528,877 A 6/1996 Franklin
5,531,539 A 7/1996 Crawford
5,584,142 A 12/1996 Spiess
5,592,796 A 1/1997 Landers
5,611,173 A 3/1997 Headrick et al.
5,628,158 A 5/1997 Porter
5,640,824 A 6/1997 Johnson
5,660,017 A 8/1997 Houghton
5,678,384 A 10/1997 Maze
5,697,189 A 12/1997 Miller
5,699,643 A 12/1997 Kinard
5,706,607 A 1/1998 Frey
5,724,773 A 3/1998 Hall
5,735,100 A 4/1998 Campbell
5,746,034 A 5/1998 Luchetti et al.
5,755,982 A 5/1998 Strickland
5,850,686 A 12/1998 Mertes
5,867,964 A 2/1999 Perrin
5,870,867 A 2/1999 Mitchell
5,921,041 A 7/1999 Egri, II
5,970,680 A 10/1999 Powers
5,987,841 A 11/1999 Campo
5,992,109 A 11/1999 Jonker
5,997,792 A 12/1999 Gordon
6,000,194 A 12/1999 Nakamura
6,055,787 A 5/2000 Gerhaher et al.
6,073,401 A 6/2000 Iri et al.
6,073,413 A 6/2000 Tongiatama
6,076,319 A 6/2000 Hendershot
6,086,350 A 7/2000 Del Monte
6,128,877 A 10/2000 Goodman et al.
6,151,851 A 11/2000 Carter
6,154,774 A 11/2000 Furlong
6,170,214 B1 1/2001 Treister et al.
6,240,704 B1 6/2001 Porter
6,243,993 B1 6/2001 Swensson
6,244,002 B1 6/2001 Martin
6,244,008 B1 6/2001 Miller
6,260,329 B1 7/2001 Mills
6,289,646 B1 9/2001 Watanabe
6,301,838 B1 10/2001 Hall
6,308,465 B1 10/2001 Galloway et al.
6,308,491 B1 10/2001 Porter
6,340,508 B1 1/2002 Frommelt
6,371,188 B1 4/2002 Baczuk
6,393,774 B1 5/2002 Fisher
6,421,968 B2 7/2002 Degelsegger
6,427,407 B1 8/2002 Wilson
6,430,883 B1 8/2002 Paz et al.
6,446,396 B1 9/2002 Marangoni et al.
6,481,172 B1 11/2002 Porter
6,484,460 B2 11/2002 VanHaitsma
6,625,937 B1 9/2003 Parker
6,651,393 B2 11/2003 Don
6,729,094 B1 5/2004 Spencer et al.
6,748,709 B1 6/2004 Sherman et al.
6,807,790 B2 10/2004 Strickland et al.
6,837,013 B2 1/2005 Foderberg et al.
6,922,960 B2 8/2005 Sataka
6,964,410 B1 11/2005 Hansen
7,007,343 B2 3/2006 Weiland
7,059,017 B1 6/2006 Rosko
7,143,555 B2 12/2006 Miller
RE39,462 E 1/2007 Brady
7,389,620 B1 6/2008 McManus
7,395,999 B2 7/2008 Walpole
7,444,793 B2 11/2008 Raftery et al.
7,467,469 B2 12/2008 Wall
7,484,329 B2 2/2009 Fiehler
7,484,339 B2 2/2009 Fiehler
7,493,729 B1 2/2009 Semmes
7,546,715 B2 6/2009 Roen
7,574,837 B2 8/2009 Hagen, Jr. et al.
7,658,045 B2 2/2010 Elliott et al.
7,676,998 B2 3/2010 Lessard
7,694,462 B2 4/2010 O'Callaghan
7,721,491 B2 5/2010 Appel
7,748,193 B2 7/2010 Knigge et al.
7,908,810 B2 3/2011 Payne, Jr. et al.
7,921,965 B1 4/2011 Surace
7,966,778 B2 6/2011 Klein
8,051,623 B2 11/2011 Loyd
8,096,084 B2 1/2012 Studebaker et al.
8,109,058 B2 2/2012 Miller
8,127,507 B1 3/2012 Bilge
8,166,716 B2 5/2012 Macdonald et al.
8,234,827 B1 8/2012 Schroeder, Sr.
8,234,833 B2 8/2012 Miller
8,251,175 B1 8/2012 Englert et al.
8,276,328 B2 10/2012 Pépin
8,322,086 B2 12/2012 Weber
8,359,808 B2 1/2013 Stephens, Jr.
8,424,251 B2 4/2013 Tinianov
8,490,349 B2 7/2013 Lutzner
8,505,259 B1 8/2013 Degtyarev
8,539,732 B2 9/2013 Leahy
8,555,581 B2 10/2013 Amend
8,555,589 B2 10/2013 Semmens et al.
8,555,598 B2 10/2013 Wagner et al.
8,621,806 B2 1/2014 Studebaker et al.
8,621,818 B1 1/2014 Glenn et al.
8,631,616 B2 1/2014 Carrion et al.
8,733,046 B2 5/2014 Naidoo
8,769,891 B2 7/2014 Kelly
8,826,613 B1 9/2014 Chrien
8,833,025 B2 9/2014 Krause
8,950,132 B2 2/2015 Collins et al.
8,966,845 B1 3/2015 Ciuperca
8,978,324 B2 * 3/2015 Collins ..... E04B 2/72 52/220.1
8,991,111 B1 3/2015 Harkins
8,997,424 B1 4/2015 Miller
9,027,307 B2 5/2015 Collins et al.
9,382,709 B2 7/2016 Collins et al.
9,637,911 B2 5/2017 Doupe et al.
9,683,361 B2 6/2017 Timberlake et al.
10,041,289 B2 8/2018 Collins et al.
10,273,686 B2 4/2019 Lake
10,323,428 B2 6/2019 Collins et al.
10,501,929 B2 12/2019 Henry
2002/0059763 A1 5/2002 Wong
2002/0092703 A1 7/2002 Gelin et al.
2002/0134036 A1 9/2002 Daudet et al.
2002/0170243 A1 11/2002 Don
2002/0184836 A1 12/2002 Takeuchi et al.
2003/0005653 A1 1/2003 Sataka
2003/0056445 A1 3/2003 Cox
2003/0084629 A1 5/2003 Strickland et al.
2003/0101680 A1 6/2003 Lee
2003/0140571 A1 7/2003 Muha et al.
2003/0167712 A1 9/2003 Robertson
2003/0167719 A1 9/2003 Alderman
2003/0200706 A1 10/2003 Kahan et al.
2003/0221381 A1 12/2003 Ting
2004/0065036 A1 4/2004 Capozzo
2004/0103596 A1 6/2004 Don
2005/0081484 A1 4/2005 Yland
2005/0108957 A1 5/2005 Quesada
2005/0188626 A1 9/2005 Johnson
2005/0188632 A1 9/2005 Rosen
2005/0198919 A1 9/2005 Hester, Jr.
2005/0204697 A1 9/2005 Rue
2005/0204699 A1 9/2005 Rue
2005/0210764 A1 9/2005 Foucher et al.
2005/0210798 A1 9/2005 Burg et al.
2005/0235571 A1 10/2005 Ewing et al.

(56) References Cited

U.S. PATENT DOCUMENTS

2005/0235581 A1 10/2005 Cohen
2005/0247013 A1 11/2005 Walpole
2005/0262771 A1 12/2005 Gorman
2006/0021289 A1 2/2006 Elmer
2006/0070321 A1 4/2006 Au
2006/0090326 A1 5/2006 Corbett
2006/0096202 A1 5/2006 Delzotto
2006/0117689 A1 6/2006 Onken et al.
2006/0137293 A1 6/2006 Klein
2006/0143856 A1 7/2006 Rosko et al.
2006/0150521 A1 7/2006 Henry
2006/0179764 A1 8/2006 Ito
2006/0248825 A1 11/2006 Garringer
2007/0000198 A1 1/2007 Payne
2007/0074464 A1 4/2007 Eldridge
2007/0107349 A1 5/2007 Erker
2007/0157539 A1 7/2007 Knigge et al.
2007/0163197 A1 7/2007 Payne et al.
2007/0209306 A1 9/2007 Andrews et al.
2007/0234657 A1 10/2007 Speyer et al.
2007/0283640 A1 12/2007 Shivak et al.
2007/0294954 A1 12/2007 Barrett
2008/0000177 A1 1/2008 Siu
2008/0057290 A1 3/2008 Guevara et al.
2008/0098676 A1 5/2008 Hutchens
2008/0099283 A1 5/2008 Reigwein
2008/0104901 A1 5/2008 Olvera
2008/0168741 A1 7/2008 Gilgan
2008/0178542 A1 7/2008 Williams
2008/0178642 A1 7/2008 Sanders
2008/0202048 A1 8/2008 Miller et al.
2008/0222981 A1 9/2008 Gobbi
2008/0229669 A1 9/2008 Abdollahzadeh et al.
2008/0245007 A1 9/2008 McDonald
2008/0282626 A1 11/2008 Powers, Jr.
2008/0289265 A1 11/2008 Lessard
2008/0295450 A1 12/2008 Yogev
2009/0031652 A1 2/2009 Ortega Gatalan
2009/0038764 A1 2/2009 Pilz
2009/0064611 A1 3/2009 Hall et al.
2009/0077916 A1 3/2009 Scuderi et al.
2009/0090074 A1 4/2009 Klein
2009/0100760 A1 4/2009 Ewing
2009/0100769 A1 4/2009 Barrett
2009/0100796 A1 4/2009 Denn et al.
2009/0107065 A1 4/2009 LeBlang
2009/0113820 A1 5/2009 Deans
2009/0134287 A1 5/2009 Klosowski
2009/0165399 A1 7/2009 Campos Gines
2009/0188192 A1 7/2009 Studebaker et al.
2009/0188193 A1 7/2009 Studebaker et al.
2009/0205277 A1 8/2009 Gibson
2009/0249714 A1 10/2009 Combs et al.
2009/0277122 A1 11/2009 Howery et al.
2009/0282766 A1 11/2009 Roen
2009/0293395 A1 12/2009 Porter
2009/0313931 A1 12/2009 Porter
2010/0050556 A1* 3/2010 Burns ..... E04B 1/34321 52/592.1
2010/0064590 A1 3/2010 Jones et al.
2010/0064601 A1 3/2010 Napier
2010/0146874 A1 6/2010 Brown
2010/0186313 A1 7/2010 Stanford et al.
2010/0212255 A1 8/2010 Lesoine
2010/0218443 A1 9/2010 Studebaker
2010/0229472 A1 9/2010 Malpas
2010/0235206 A1 9/2010 Miller et al.
2010/0263308 A1 10/2010 Olvera
2010/0275544 A1 11/2010 Studebaker et al.
2010/0325971 A1 12/2010 Leahy
2010/0325989 A1 12/2010 Leahy
2011/0023381 A1 2/2011 Weber
2011/0041411 A1 2/2011 Aragon
2011/0056147 A1 3/2011 Beaudet
2011/0113709 A1 5/2011 Pilz
2011/0113715 A1 5/2011 Tonyan et al.
2011/0126484 A1 6/2011 Carrion et al.
2011/0154766 A1 6/2011 Kralic et al.
2011/0162167 A1 7/2011 Blais
2011/0219720 A1 9/2011 Strickland et al.
2011/0247281 A1 10/2011 Pilz et al.
2011/0268916 A1 11/2011 Pardue, Jr.
2011/0296769 A1* 12/2011 Collins ..... E04B 1/003 52/79.1
2011/0296778 A1 12/2011 Collins et al.
2011/0296789 A1* 12/2011 Collins ..... E04B 1/24 52/741.4
2011/0300386 A1 12/2011 Pardue, Jr.
2012/0073227 A1 3/2012 Urusoglu
2012/0151869 A1 6/2012 Miller
2012/0167505 A1 7/2012 Krause
2012/0186174 A1 7/2012 LeBlang
2012/0210658 A1 8/2012 Logan
2012/0291378 A1 11/2012 Schroeder et al.
2012/0297712 A1 11/2012 Lutzner et al.
2012/0317923 A1 12/2012 Herdt et al.
2013/0025222 A1 1/2013 Mueller
2013/0025966 A1 1/2013 Nam et al.
2013/0036688 A1 2/2013 Gosain
2013/0067832 A1 3/2013 Collins et al.
2013/0111840 A1 5/2013 Bordener
2013/0133277 A1 5/2013 Lewis
2013/0232887 A1 9/2013 Donnini
2014/0013678 A1 1/2014 Deverini
2014/0013684 A1 1/2014 Kelly et al.
2014/0013695 A1 1/2014 Wolynski et al.
2014/0047780 A1 2/2014 Quinn et al.
2014/0059960 A1 3/2014 Cole
2014/0069035 A1 3/2014 Collins et al.
2014/0069040 A1 3/2014 Gibson
2014/0069050 A1 3/2014 Bolin
2014/0083046 A1 3/2014 Yang
2014/0090323 A1 4/2014 Glancy
2014/0130441 A1 5/2014 Sugihara et al.
2014/0317841 A1 10/2014 Dejesus et al.
2014/0338280 A1 11/2014 Tanaka et al.
2015/0007415 A1* 1/2015 Kalinowski ..... E05D 11/1007 16/319
2015/0093184 A1 4/2015 Henry
2015/0096251 A1 4/2015 McCandless et al.
2015/0136361 A1 5/2015 Gregory
2015/0152634 A1* 6/2015 Unger ..... E04B 1/3483 52/79.2
2015/0211227 A1 7/2015 Collins et al.
2015/0233108 A1 8/2015 Eggleston, II et al.
2015/0252558 A1 9/2015 Chin
2015/0284950 A1* 10/2015 Stramandinoli ..... E04B 2/90 52/235
2015/0297926 A1 10/2015 Dzegan
2015/0308096 A1 10/2015 Merhi et al.
2016/0002912 A1 1/2016 Doupe et al.
2016/0053475 A1 2/2016 Locker et al.
2016/0122996 A1 5/2016 Timberlake et al.
2016/0145933 A1* 5/2016 Condon ..... E06B 3/66 52/204.5
2016/0258160 A1 9/2016 Radhouane et al.
2016/0290030 A1 10/2016 Collins et al.
2016/0319534 A1 11/2016 Bernardo
2017/0037613 A1 2/2017 Collins et al.
2017/0284095 A1 10/2017 Collins et al.
2017/0299198 A1 10/2017 Collins et al.
2017/0306624 A1 10/2017 Graham et al.
2017/0306625 A1 10/2017 Collins et al.
2018/0038103 A1 2/2018 Neumayr
2018/0148926 A1 5/2018 Lake
2018/0209136 A1 7/2018 Aylward et al.
2018/0223521 A1 8/2018 Uno et al.
2018/0328056 A1 11/2018 Collins et al.
2019/0032327 A1 3/2019 Musson
2019/0136508 A1 5/2019 Chaillan

(56) References Cited

U.S. PATENT DOCUMENTS

FOREIGN PATENT DOCUMENTS

| | | | | |
|---|---|---|---|---|
| CN | 1313921 | | 9/2001 | |
| CN | 1234087 | | 11/2002 | |
| CN | 20137279 | | 3/2008 | |
| CN | 101426986 | | 5/2009 | |
| CN | 101821462 | | 9/2010 | |
| CN | 101831963 | | 9/2010 | |
| CN | 102105642 | | 6/2011 | |
| CN | 202117202 | | 1/2012 | |
| CN | 102459775 | | 5/2012 | |
| CN | 102587693 | | 7/2012 | |
| CN | 202299241 | | 7/2012 | |
| CN | 202391078 | | 8/2012 | |
| CN | 102733511 | | 10/2012 | |
| CN | 205024886 | | 2/2016 | |
| CN | 108487464 | | 9/2018 | |
| DE | 4205812 | | 9/1993 | |
| DE | 9419429 | U1 * | 2/1995 | ..... E04B 2/7448 |
| DE | 20002775 | | 8/2000 | |
| DE | 19918153 | | 11/2000 | |
| DE | 20315506 | | 11/2004 | |
| DE | 202008007139 | | 10/2009 | |
| EP | 1045078 | | 10/2000 | |
| EP | 0235029 | | 2/2002 | |
| EP | 1375804 | | 1/2004 | |
| EP | 2128353 | | 12/2009 | |
| EP | 2213808 | | 8/2010 | |
| EP | 2238872 | | 10/2010 | |
| EP | 1739246 | | 1/2011 | |
| EP | 2281964 | | 2/2011 | |
| EP | 3133220 | | 2/2017 | |
| FR | 1317681 | | 5/1963 | |
| FR | 2988749 | | 10/2013 | |
| FR | 2765906 | | 1/2019 | |
| GB | 898905 | | 6/1962 | |
| GB | 2481126 | A * | 12/2011 | ..... E04B 2/90 |
| JP | S46-006980 | | 12/1971 | |
| JP | S49-104111 | | 9/1974 | |
| JP | 52-015934 | | 4/1977 | |
| JP | 53-000014 | | 1/1978 | |
| JP | 53-156364 | | 12/1978 | |
| JP | 56-131749 | | 10/1981 | |
| JP | 57-158451 | | 9/1982 | |
| JP | S59-065126 | | 5/1984 | |
| JP | S60-019606 | | 2/1985 | |
| JP | 61-144151 | | 9/1986 | |
| JP | S61-201407 | | 12/1986 | |
| JP | H01-153013 | | 10/1989 | |
| JP | H0130985 | | 1/1991 | |
| JP | H0310985 | | 1/1991 | |
| JP | H049373 | | 3/1992 | |
| JP | 6-12178 | | 2/1994 | |
| JP | H06220932 | | 8/1994 | |
| JP | H0752887 | | 12/1995 | |
| JP | 8-189078 | | 7/1996 | |
| JP | H08189078 | | 7/1996 | |
| JP | H09228510 | | 9/1997 | |
| JP | 2576409 | Y2 | 7/1998 | |
| JP | 10234493 | | 9/1998 | |
| JP | H10245918 | | 9/1998 | |
| JP | 11-117429 | | 4/1999 | |
| JP | H11-100926 | | 4/1999 | |
| JP | 2000-34801 | | 2/2000 | |
| JP | 2000144997 | | 5/2000 | |
| JP | 2000-160861 | | 6/2000 | |
| JP | 3137760 | | 2/2001 | |
| JP | 3257111 | | 2/2002 | |
| JP | 2002-309691 | | 10/2002 | |
| JP | 2002536615 | | 10/2002 | |
| JP | 2002364104 | | 12/2002 | |
| JP | 2003-505624 | | 2/2003 | |
| JP | 2003-278300 | | 10/2003 | |
| JP | 2003-293493 | | 10/2003 | |
| JP | 2003278300 | | 10/2003 | |
| JP | 2004108031 | | 4/2004 | |
| JP | 2004-344194 | | 12/2004 | |
| JP | 3664280 | | 6/2005 | |
| JP | 2006-161406 | | 6/2006 | |
| JP | 3137760 | | 12/2007 | |
| JP | 2008-063753 | | 3/2008 | |
| JP | 2008073434 | | 4/2008 | |
| JP | 2008110104 | | 5/2008 | |
| JP | 2009-257713 | | 11/2009 | |
| JP | 2010185264 | | 8/2010 | |
| JP | 2010245918 | | 10/2010 | |
| JP | 2011032802 | | 2/2011 | |
| JP | 3187449 | | 11/2013 | |
| JP | 2015-117502 | | 6/2015 | |
| KR | 1019990052255 | | 7/1999 | |
| KR | 1019990053902 | | 7/1999 | |
| KR | 100236196 | | 12/1999 | |
| KR | 102000200413000 | | 10/2000 | |
| KR | 20060066931 | | 6/2006 | |
| KR | 20080003326 | | 8/2008 | |
| KR | 101481790 | | 1/2015 | |
| KR | 20180092677 | | 8/2018 | |
| WO | 1991007557 | | 5/1991 | |
| WO | 1997022770 | | 6/1997 | |
| WO | 200046457 | | 8/2000 | |
| WO | 0058583 | | 10/2000 | |
| WO | 2002035029 | | 5/2002 | |
| WO | 2006091864 | | 8/2006 | |
| WO | 2007059003 | | 5/2007 | |
| WO | 2007/080561 | | 7/2007 | |
| WO | 2010030060 | | 3/2010 | |
| WO | 2010037938 | | 4/2010 | |
| WO | 2011015681 | | 2/2011 | |
| WO | 2015050502 | | 4/2015 | |
| WO | 2016032537 | | 3/2016 | |
| WO | 2016032538 | | 3/2016 | |
| WO | 2016032539 | | 3/2016 | |
| WO | 2016032540 | | 3/2016 | |
| WO | 2016033429 | | 3/2016 | |
| WO | 2016033525 | | 3/2016 | |

OTHER PUBLICATIONS

European Search Report in PCT/US2015/047383 dated Jun. 22, 2018, 10 Pages.

WIPO, International Search Report and Written opinion for International Application No. PCT/US/2014/053614 dated Dec. 18, 2014, 11 pages.

WIPO, International Search Report and Written opinion for International Application No. PCT/US/2014/053615 dated Dec. 17, 2014, 11 pages.

WIPO, International Search Report and Written opinion for International Application No. PCT/US/2014/053613 dated Dec. 18, 2014, 13 Pages.

WIPO, International Search Report and Written Opinion for International Application No. PCT/US2011/001039 dated Oct. 5, 2011, 14 Pages.

WIPO, International Search Report and Written opinion for International Application No. PCT/US2015/047383 dated Jan. 12, 2016, 14 Pages.

WIPO, International Search Report and Written opinion for International Application No. PCT/US15/47536 dated Dec. 4, 2015, 17 Pages.

European Search Report received for POT 14891125.8-1604/3011122 dated Jul. 8, 2016, 4 pages.

WIPO, International Search Report and Written opinion for International Application No. PCT/US/2014/053616 dated Dec. 17, 2014, 9 Pages.

WIPO, International Search Report and Written Opinion for PCT Application No. PCT/US2011/001039 dated Oct. 5, 2011, 9 Pages.

"Beam to column connection", TATA Steel, http://www.tatasteelconstruction.com/en/reference/teaching_resources/architectural_studio_reference/elements/connections/beam to column connections, 2014, 4 Pages.

"Emerging Trends 2012 Executive Summary", Urban Land Institute, Ch. 1, 2011, 1-11 Pages.

(56) References Cited

OTHER PUBLICATIONS

"Emerging Trends in real estate", accessed on Sep. 15, 2016 at https://web.archive.orglweb120140813084823/http://pwc.corn.au/industry/ real-estate/assets/Real-Estate-2012-Europe-Jan12.pdf, pp. 60, 2012.
"Extended European Search Report for European Application No. EP 15836516.3", dated Jun. 22, 2018, 1 page.
"Extended European Search Report for European Patent Application No. 14900469", dated Mar. 20, 2018, 1-8.
"How to Soundproof a Ceiling—Soundproofing Ceilings", http://www.soundproofingcompany.com/soundproofing-solutions/soundproof-a-ceiling/, Apr. 2, 2014, 1-7 Pages.
"Insulspan Installation Guide", Obtained at: http://www.insuispan.comidownloads:InstallationGuide,pdf on Feb. 2, 2016, 58 pages.
"Structural Insulated Panel", Wikipedia, http: //www.en.wikipedia.org//wiki/Structural_insulated_panel, May 30, 2014, 5 Pages.
"Structural Insulated Panels", SIP Solutions, http://www.sipsolutions.com/content/structuralinsulated-panels, Aug. 15, 2014, 3 pages.
"US Apartment & Condominium Construction Forecast 2003-2017", Statista, Inc., Jun. 2012, 8 Pages.
Azari, et al., "Modular Prefabricated Residential Construction—Constraints and Opportunities", PNCCRE Technical Report #TR002, Aug. 2013, 90 Pages.
Borzouie, Jamaledin, et al., "Seismic Assesment and Reahbilitation of Diaphragms", http://www.nosazimadares.ir/behsazi/15WCEE2012/URM/1/Roof.pdf, Dec. 31, 2011, 86 Pages.
EPO, Communication Pursuant to Article 94(3) EPC mailed for EP application No. 15836516.3, dated Apr. 25, 2019, 4 pages.
EPO, Communication Pursuant to Article 94(3) EPC for European Patent Application No. 15836516.3, dated Aug. 2, 2019, 4 pages.
EPO, Communication Pursuant to Article 94(3) EPC mailed for European patent application No. 14900469.9, dated Jun. 18, 2019, 5 pages.
FRAMECAD, "FC EW 1-12mm Fibre Cement Sheet + 9mm MgO Board Wall Assembly", 2013, 2 pages.
Giles, et al., "Innovations in the Development of Industrially Designed and Manufactured Modular Concepts for Low-Energy, Multi-Story, High Density, Prefabricated Affordable Housing", Innovations in the Development of Industrially Designed and Manufactured Modular Concepts, 2006, 1-15 Pages.
Gonchar, "Paradigm Shift—Multistory Modular", Architectural Record, Oct. 2012, 144-148 Pages.
Kerin, et al., "National Apartment Market Report—2013", Marcus & Millichap, 2013, 1-9 pages.
M.A. Riusillo, "Lift Slab Construction: Its History, Methodology, Economics and Applications", ACI-Abstract, Jun. 1, 1988, 2 pages.
McIlwain, "Housing in America—The Next Decade", Urban Land Institute, 2010, 1-28 Pages.
McIlwain, "The Rental Boost From Green Design", Urban Land, http://urbanland.uli.org/sustainability/the-rental-boost-from-green-design/, Jan. 4, 2012, 1-6 Pages.
Shashaty, Andre, "Housing Demand", Sustainable Communities, Apr. 2011, 14-18 Pages.
Sichelman, "Severe Apartment Shortage Looms", Urban Land, http://urbanland.uli.org/capital-markets/nahb-orlando-severe-apartmentshortage-looms/, Jan. 13, 2011, 1-2 Pages.
Stiemer, S F, "Bolted Beam-Column Connections", http://faculty.philau.edu/pastorec/Tensile/bolted_beam_column_connections. pdf, Nov. 11, 2007, 1-16 Pages.
WIPO, International Search Report for International Patent Application No. PCT/US2017/021174, dated Jun. 26, 2017, 11 pages.
WIPO, International Search Report for International Patent Application No. PCT/US2017/021168, dated May 19, 2017, 5 pages.
WIPO, Written Opinion for International Patent Application No. PCT/US2017/021174, dated Jun. 26, 2017, 6 pages.
WIPO, International Search Report for International Patent Application No. PCT/US2017/021179, dated May 25, 2017, 7 pages.
WIPO, Written Opinion for International Patent Application No. PCT/US2017/021179, dated May 25, 2017, 7 pages.
WIPO, International Search Report of International Patent Application No. PCT/US2017/021177, dated Jun. 5, 2017, 8 pages.
WIPO, Written Opinion of International Patent Application No. PCT/US2017/021177, dated Jun. 5, 2017, 8 pages.
WIPO, Written Opinion for International Patent Application No. PCT/US2017/021168, dated May 19, 2017, 8 pages.
WIPO, International Search Report and Written Opinion mailed for International application No. PCT/US2014/053614 dated Dec. 18, 2014, 11 pages.
WIPO, International Search Report and Written Opinion mailed for International application No. PCT/US2014/053615 dated Dec. 17, 2014, 11 Pages.
WIPO, International Search Report and Written Opinion mailed for International application No. PCT/US2019/031370, dated Aug. 7, 2019, 11 pages.
WIPO, International Search Report and Written Opinion mailed for International application No. PCT/US2014/053613 dated Dec. 18, 2014, 13 pages.
WIPO, International Search Report and Written Opinion mailed for International application No. PCT/US2015/047536 dated Dec. 4, 2015, 17 Pages.
WIPO, International Search Report and Written Opinion mailed for International application No. PCT/US2014/053616 dated Dec. 17, 2014, 9 Pages.
USPTO, International Search Report of International Patent Application No. PCT/US2017/021177, dated Jun. 5, 2017, 8 pages.
USPTO, Written Opinion of International Patent Application No. PCT/US2017/021177, dated Jun. 5, 2017, 8 pages.
EPO, Extended European Search Report for European Patent Application No. 17763914.3, dated Nov. 19, 2019, 10 pages.
EPO, Extended European Search Report for European Patent Application No. 17763913.5, dated Oct. 16, 2019, 8 pages.
EPO, Partial European Search Report for European Patent Application No. 17763910.1, dated Oct. 17, 2019, 16 pages.
EPO, Extended European Search Report for European Patent Application No. 17763907.7, dated Sep. 13, 2019, 13 pages.
WIPO, "International Search Report and Written Opinion for PCT Application No. PCT/US2019/038557", dated Sep. 4, 2019, 67 pages.
EPO, Extended European Search Report for European Patent Application No. 17763910.1, dated Jan. 28, 2020, 13 pages.

* cited by examiner

WATERPROOFING ASSEMBLIES AND PREFABRICATED WALL PANELS INCLUDING THE SAME

CROSS-REFERENCE TO RELATED APPLICATIONS

The present application is a U.S. National Stage filing under 35 U.S.C. § 371 of International Application No. PCT/US2017/021177, filed on Mar. 7, 2017, which claims priority under 35 U.S.C. § 119(e) to U.S. Provisional Application No. 62/304,858 filed on Mar. 7, 2016, both of which are incorporated by reference, in their entirety, for any purpose.

BACKGROUND

Conventional construction is conducted in the field at the building job site. People in various trades (e.g., carpenters, electricians, and plumbers) measure, cut, and install material as though each unit were one-of-a-kind. Furthermore, activities performed by the trades are arranged in a linear sequence. The result is a time-consuming process that increases the risk of waste, installation imperfections, and cost overruns. One approach to improving efficiency in building construction may be modular construction. In the case of buildings with multiple dwelling units (e.g., apartments, hotels, student dorms, etc.), entire dwelling units (referred to as modules) may be built off-site in a factory and then trucked to the job site. The modules are then stacked and connected together, generally resulting in a low-rise construction (e.g., between one and six stories). Other modular construction techniques may involve the building of large components of the individual units off-site (e.g., in a factory) and assembling the large components in the field to reduce the overall construction effort at the job site and thereby reducing the overall time of erecting the building. However, shortcomings may exist with known modular building technologies and improvements thereof may be desirable.

SUMMARY

Techniques are generally described that include systems and methods relating to building construction and more specifically relating to the sealing of a building envelope.

An example system may include a pre-assembled wall panel, which may include a panel frame including a perimeter member defining a perimeter side of the panel frame, first and second wall boards attached to opposite sides of the panel frame to define first and second major sides of the wall panel, each of the first and second wall boards including non-combustible material, and a waterproofing assembly enclosing the perimeter side of the panel frame and extending along a full length of the perimeter side, wherein the waterproofing assembly includes a non-metallic elongate member including first and second opposing flanges disposed against respective exterior surfaces of the first and second wall boards, and wherein the first and second opposing flanges are attached to the perimeter member.

An example multi-story building may include a structural frame including a first horizontal beam associated with a lower story of the building and a second horizontal beam associated with an upper story of the building and a pre-assembled wall panel attached to the structural frame between the first and second horizontal beams, wherein the wall panel includes a panel frame and wall boards attached to opposite sides of the panel frame, and wherein the wall panel further includes a non-metallic waterproofing assembly extending along a vertical perimeter side of the panel frame, the waterproofing assembly enclosing the vertical perimeter side and a vertical edge of each of the wall boards.

An example method may include attaching a first pre-assembled wall panel to a structural frame of a building, wherein the structural frame includes a first beam and a second beam opposite and spaced apart from the first beam, and wherein the first pre-assembled wall panel is disposed at least partially over the first beam. The example method may further include attaching a second pre-assembled wall panel to the structural frame opposite and spaced apart from the first pre-assembled wall panel, the second pre-assembled wall panel disposed at least partially over the second beam, wherein each of the first and second pre-assembled wall panels includes at least one non-metallic waterproofing assembly along a perimeter side of respective one of the first or second pre-assembled wall panels. The example method may be used to construct a wall system for a building.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings, in which:

DETAILED DESCRIPTION

Figure 1:
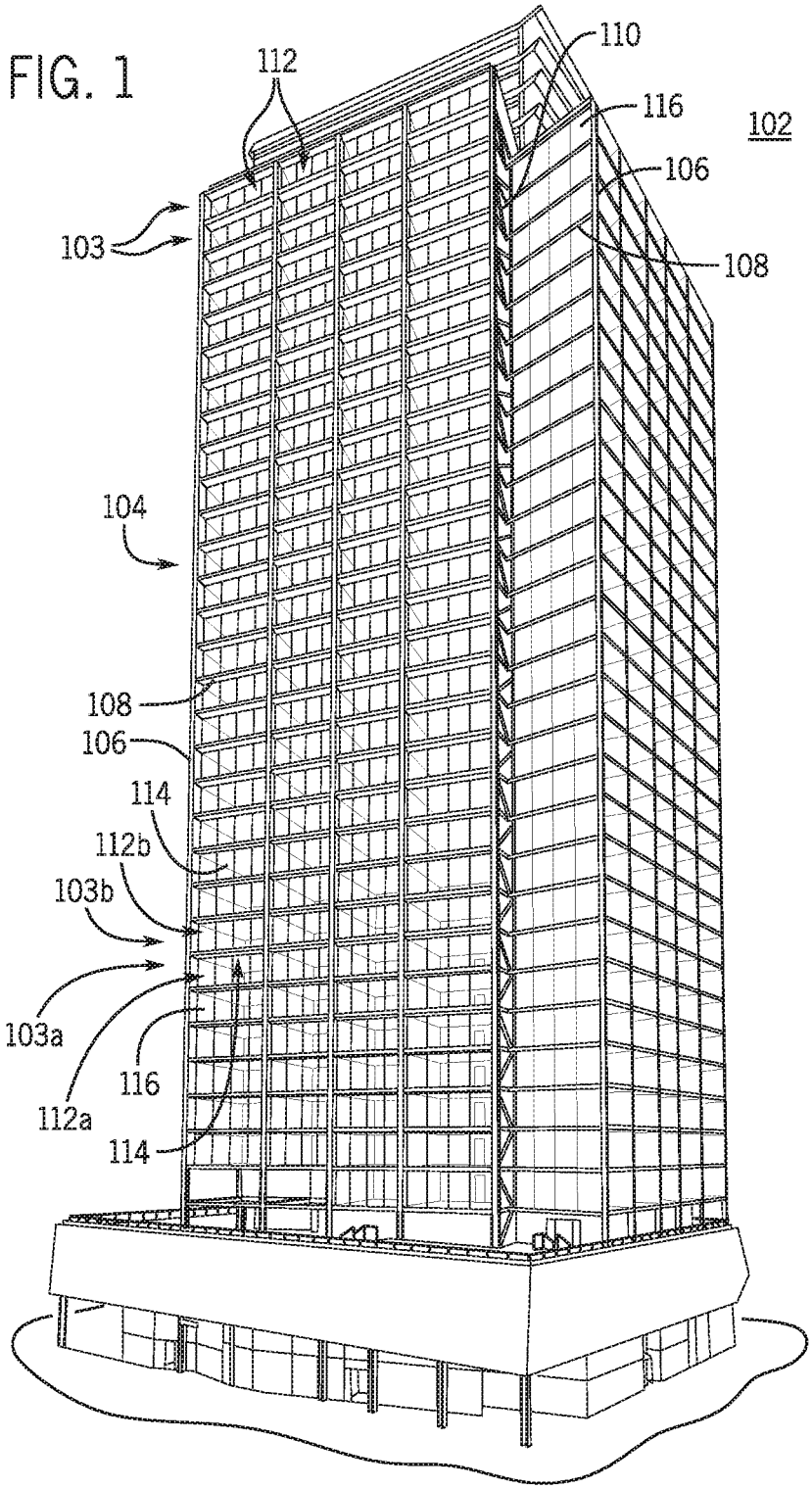
FIG. 1 illustrates an example multi-story building in accordance with some examples of the present disclosure.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the Figures, can be arranged, substituted, combined, separated, and designed in a wide variety of different configurations, all of which are implicitly contemplated herein.

This disclosure is drawn, inter alia, to methods, systems, products, devices, and/or apparatus generally related to waterproofing and/or thermally insulating a building envelope. Described are waterproofing assemblies or components that may be included with prefabricated wall panels or attached elsewhere in a building. For example, a wall panel in accordance with the present disclosure may be a pre-assembled panel for use in modular building construction. In some examples, the wall panel may be assembled off-site in a shop and then transported to the building site. At the building site, the wall panel may be attached directly or indirectly to a building frame. The wall panel may define part of or the whole of a wall of the building, such as a part or the whole of a wall of a unit within the building. In some examples, the wall panel may define a wall or part of a wall of a unit in one story of the building and may also define a wall or part of a wall of another unit, for example a vertically or horizontally adjacent unit) in the same or another story of the building. Wall panels in accordance with the present disclosure may be provided with one or more waterproofing assemblies. The waterproofing assemblies may be arranged such that they are positioned at interfaces between adjoining panels and may function to resist moisture intrusion between the adjoining panels.

A wall panel may include a panel frame and first and second wall boards attached to opposite sides of the frame. The wall boards may define the major sides of the wall panel. When installed in a building, the two wall boards may be horizontally spaced from one another by the frame. The panel frame may include a plurality of studs joined to opposing end members. The outer studs and the end members may be collectively referred to as perimeter members in that they may define the perimeter of the panel frame. The perimeter members may define perimeter sides of the wall panel. The perimeter members and wall boards may define a substantially enclosed space therebetween, the space divided into wall cavities by the plurality of studs. The wall boards may be connected (e.g., mechanically fastened) to the studs and end members. In some examples, the one or more wall cavities may accommodate plumbing, cabling, wiring, or other conduits or other elements that may support dwelling or commercial units in the buildings. An insulative material may be located in one or more of the wall cavities. In some examples, cross members may be provided in or operatively arranged relative to the one or more wall cavities, for example for increasing the lateral stability of the panel. In some examples, the cross members may be implemented in the form of straps, such as metal straps, connected between opposite corners of a wall cavity. Sound dampener material (also referred to as sound insulative material) may be positioned between the frame, the wall boards or any other layers of the wall panel.

In some examples, the wall panel may include one or more waterproofing assemblies, which may extend along one or more perimeter sides of the wall panel. A waterproofing assembly may provide functionality associated with sealing the building's envelope. In some examples, the waterproofing assemblies may aid is waterproofing interior (e.g., conditioned) spaces from the exterior of the building. In some examples, the waterproofing assembly may also aid in and thermally insulating interior (e.g., conditioned) spaces from the exterior (e.g., unconditioned spaces). In some examples, the waterproofing assembly may be formed of a water impervious material, such as, metal, plastic, fiber-reinforced plastic or other composite material. In some examples, for example when the waterproofing assembly also functions as a thermal isolator, the waterproofing assembly may be formed from thermally non-conductive materials such as plastic, fiber-reinforced plastic or other composite materials.

In some embodiments, the material composition of the panel frame may be predominantly metal. In some embodiments it may be predominately aluminum. In some embodiments one or more components of the panel frame may be made from fiber-reinforced plastic or other composite materials (e.g., carbon-fiber reinforced or aramid reinforced composite materials). The wall boards may be made from a variety of non-combustible materials. As will be understood by those skilled in the art, a non-combustible material may be a material which may not readily ignite, burn, support combustion or release flammable vapors when subjected to fire or heat. Examples of non-combustible materials include inorganic mineral materials such as cement, gypsum, and magnesium oxide as may be typically used in interior and exterior sheathing products. Other examples may include glass, glass fibers or glass/fiberglass cladding, which may be used in combination with an inorganic mineral product, for example for reinforcing a core or for lining sides of a core formed of an inorganic mineral product. In still other embodiments, the wall panel or components thereof may be made from a variety of building suitable materials ranging from metals, to wood and wood polymer composites (WPCs), wood based products (lignin), other organic building materials (bamboo) to organic polymers (plastics), to hybrid materials, or earthen materials such as ceramics. In some embodiments cement or other pourable or moldable building materials may also be used. In other embodiments, any combination of suitable building material may be combined by using one building material for some elements of the panel and other building materials for other elements of the panel. Selection of any material may be made from a reference of material options (such as those provided for in the International Building Code), or selected based on the knowledge of those of ordinary skill in the art when determining load bearing requirements for the structures to be built. Larger and/or taller structures may have greater physical strength requirements than smaller and/or shorter buildings. Adjustments in building materials to accommodate size of structure, load and environmental stresses can determine optimal economical choices of building materials used for all components in the system described herein. Availability of various building materials in different parts of the world may also affect selection of materials for building the panel described herein. Adoption of the International Building Code or similar code may also affect choice of materials.

Any reference herein to "metal" includes any construction grade metals or metal alloys as may be suitable for fabrication and/or construction of the system and components described herein. Any reference to "wood" includes wood, wood laminated products, wood pressed products, wood polymer composites (WPCs), bamboo or bamboo related products, lignin products and any plant derived product, whether chemically treated, refined, processed or simply harvested from a plant. Any reference herein to "concrete" includes any construction grade curable composite that includes cement, water, and a granular aggregate. Granular aggregates may include sand, gravel, polymers, ash and/or other minerals.

In referring now to the drawings, repeating units of the same kind or generally fungible kind, are designated by the part number and a letter (e.g. 214*n*), where the letters "a", "b" and so on refer to a discrete number of the repeating items. General reference to the part number followed by the letter "n" indicates there is no predetermined or established limit to the number of items intended. The parts are listed as "a-n" referring to starting at "a" and ending at any desired number "n".

FIG. 1 illustrates an example multi-story building 102, arranged in accordance with at least some embodiments described herein. FIG. 1 shows building 102, stories 103, structural frame 104, columns 106, beams 108, cross braces 110, units 112, floor-ceiling panel 114, and walls 116. The various components shown in FIG. 1 are merely illustrative, and other variations, including eliminating components, combining components, and substituting components are all contemplated.

The building 102 may include two or more stories or levels 103. The building 102 may be classified as a low-rise, mid-rise, or high-rise construction depending on the number of stories (each city or zoning authority may define building heights in any fashion they deem proper). The building 102 may include one or more wall panels 116 which may define walls of one or more units 112 of the building 102. In some examples, one or more of the wall panels 116 may be non-load bearing and may be arranged proximate one or more elements of the building's structural frame 104. The wall panels as described herein may be suitable for use in a building of any number of stories (levels), including a mid-rise building and a high-rise building. In some embodiments, the building may be a residential multi-dwelling building having eight or more stories. In some embodiments, the building may have fifteen or more, or in some examples thirty or more stories.

The building 102 may include a structural frame 104. The structural frame 104 may serve as a structural skeleton of the building 102. The structural frame 104 may include multiple columns 106, beams 108, and cross braces 110. The columns 106 may be oriented vertically, the beams 108 may be oriented horizontally, and the cross braces 110 may be oriented obliquely to the columns 106 and the beams 108. The beams 108 may extend between and be attached to adjacent columns 106 to connect the adjacent columns 106 to one another. The cross braces 110 may extend between and be attached to contiguous beams 108 and columns 106 to provide additional stiffness to the structural frame 104. In various embodiments described herein, the structural frame 104 may provide the structural support for the building 102. In some embodiments described herein, interior (demising) walls forming units or modules may not be load bearing walls. In some embodiments, the load bearing support may be provided by the structural frame 104. The columns, beams and cross braces may be arranged to provide most or substantially all the structural support for building 102. The frame may be used to provide decoration or added support to the structure as well.

The building 102 may include multiple units or modules 112 operatively arranged relative to the structural frame 104. The units 112 may be commercial, residential (such as dwelling units), or both. The units 112 may be assembled at the building site using multiple pre-assembled or prefabricated components. The prefabricated components may be assembled independent of one another remotely from the building site and transported to the building site for installation. The components may be attached to the structural frame 104, to adjacent components, or both at the building site to form the individual units 112. In some embodiments, the building 102 may include internal support structures. Prefabricated components may be attached to the internal support structures in some embodiments. In some examples, the use of prefabricated components as described herein may significantly reduce the field time for constructing a building, such as building 102. Each story or level 103 of the building 102 may include one or multiple units 112 defined by the prefabricated components. The units may be standardized and repetitive, or unique and individualized. Mixed units of standard size and shape may be combined with unique units in the same floor, or in independent arrangement on separate floors. In some embodiments, a unit may encompass more than one floor.

The components may include one or more pre-assembled floor-ceiling panels 114 and one or more pre-assembled wall panels 116. The floor-ceiling panels 114 may be oriented horizontally and may define the floor of an upper unit and the ceiling of a lower unit. Individual floor-ceiling panels 114 may be arranged adjacent to one another in the horizontal direction and attached to one another, one or more columns 106, one or more beams 108, or any combination thereof. In some examples, the floor-ceiling panels may be attached to columns 106, beams 108, or combinations thereof only around a perimeter of the panels. The wall panels 116 may be oriented vertically and may provide interior (e.g., demising) and exterior (e.g., envelope) walls of the building. Interior (e.g., demising) walls may partition each story into multiple units, a single unit into multiple rooms, or combinations thereof. The wall panels 116 may be attached to the floor-ceiling panels 114 with fasteners and then caulked, sealed, or both. In some examples, the wall panels 116 are arranged proximate horizontal structural members (e.g., beams 108) and/or vertical structural members (e.g., columns 106) of the structural frame 104. In some examples, the wall panels 116 may be substantially aligned or may be offset but generally parallel with a horizontal and/or a vertical structural member. Panels and/or components thereof may be attached to other structures or components using various techniques such as by mechanically fastening, such as with rivets, threaded fasteners (e.g., screws, bolts, nut and bolt combinations, and the like), or other types of mechanical fasteners. In some examples, components may be bonded (e.g., adhered or glued) to other components. Various techniques for joining components may be used without departing from the scope of the present disclosure.

Figure 2:
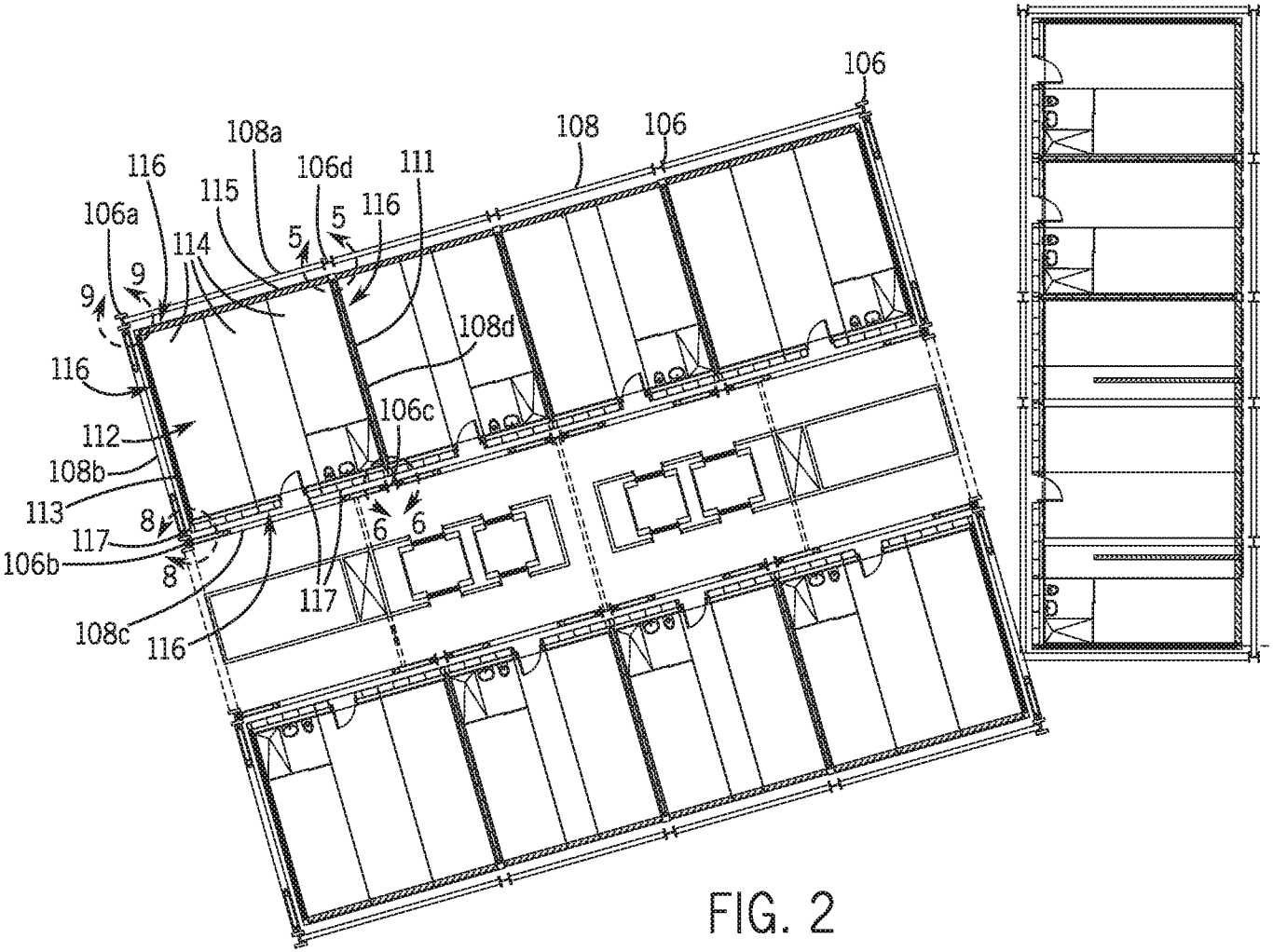
FIG. 2 illustrates example floor plans of a multi-story building, such as the building in FIG. 1.

FIG. 2 illustrates example floor plans of a multi-story building, such as building 102. FIG. 2 shows unit 112, floor-ceiling panels 114, wall panels 116 including a demising wall panel 111, an end wall panel 113, a window wall 115, and a utility wall panel 117 according to some examples herein. FIG. 2 also shows columns 106 and beams 108 of the building's structural frame. The various components shown in FIG. 2 are merely illustrative, and other variations, including eliminating components, combining components, and substituting components are all contemplated.

The wall panels 116 may define walls that partition the interior of the building, walls that include plumbing components, walls that include window components, and others. Walls that define partitions between units and or rooms within a unit may be referred to as demising walls (e.g., defined by demising wall panel 111). Typically, demising wall panels define internal walls, and may be substantially enclosed and thus not substantially exposed to the elements. External wall panels may define external walls that define, at least partially, an envelope of the building 102, and which may be referred to as envelope walls. At least one wall in a unit may include plumbing components and may be referred to as a utility wall (e.g., as defined by one or more utility wall panels 117) and walls that include window components may be referred to as window walls (e.g., window wall 115). End wall panels (e.g., end wall panel 113) may be positioned around a perimeter of the building and may define end walls of the building. Envelope walls may include, as examples and without limitation, one or more utility walls, one or more window walls, and one or more end walls. In some examples, one or more of the wall panels 116 may be arranged only around the perimeter of one or a plurality of adjoining pre-assembled floor-ceiling panels 114.

In some examples, a wall panel may span the full or substantially the full distance between two columns. For example, end wall panel 113 may span the full or substantially the full distance between the columns 106*a* and 106*b*. As another example, the demising wall panel 111 may span the full or substantially the full distance (e.g., the full distance but for the distance occupied by mounting component used to attach the wall panel to the structural frame) between the columns 106*c* and 106*d*. In some examples, a wall panel (e.g., end wall panel 113, demising wall panel 111) may have a length corresponding to a length of a floor-ceiling panel 114. In some examples, a wall panel may span a partial distance between two columns. For example, utility wall panel 117 may span only a part of the distance between columns 106*b* and 106*c*. A wall panel 116 may have a length corresponding to a width of a floor-ceiling panel 114. In the illustrated example in FIG. 2, the unit 112 may include three floor-ceiling panels 114. Utility wall panels 117 may substantially align (e.g., have a length correspond to the width of each floor panel). Other lengths and combinations for the wall panels 116 may be used.

Figure 3:
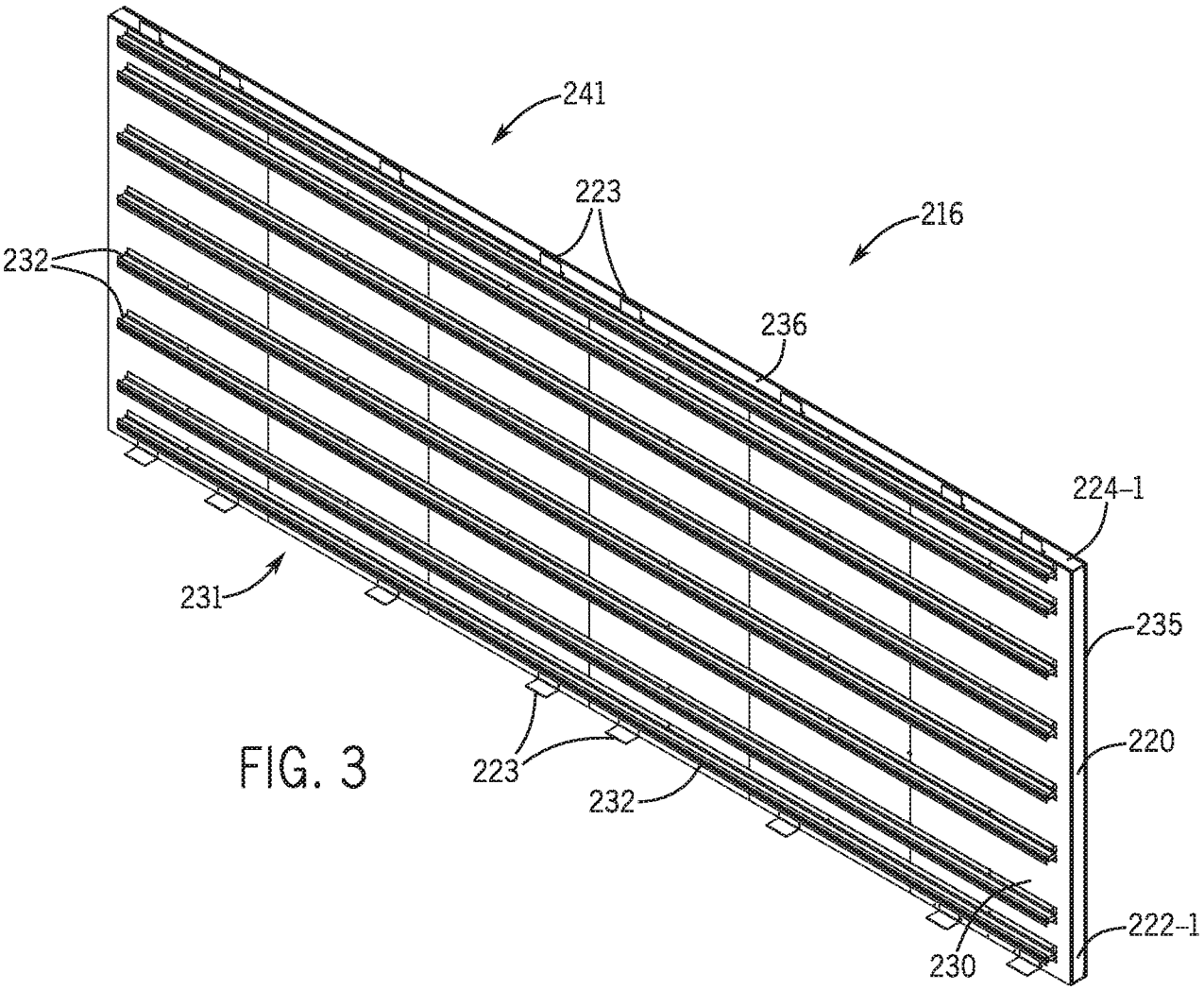
FIG. 3 shows an isometric view of a pre-assembled wall panel in accordance with some examples of the present disclosure.
Figure 4:
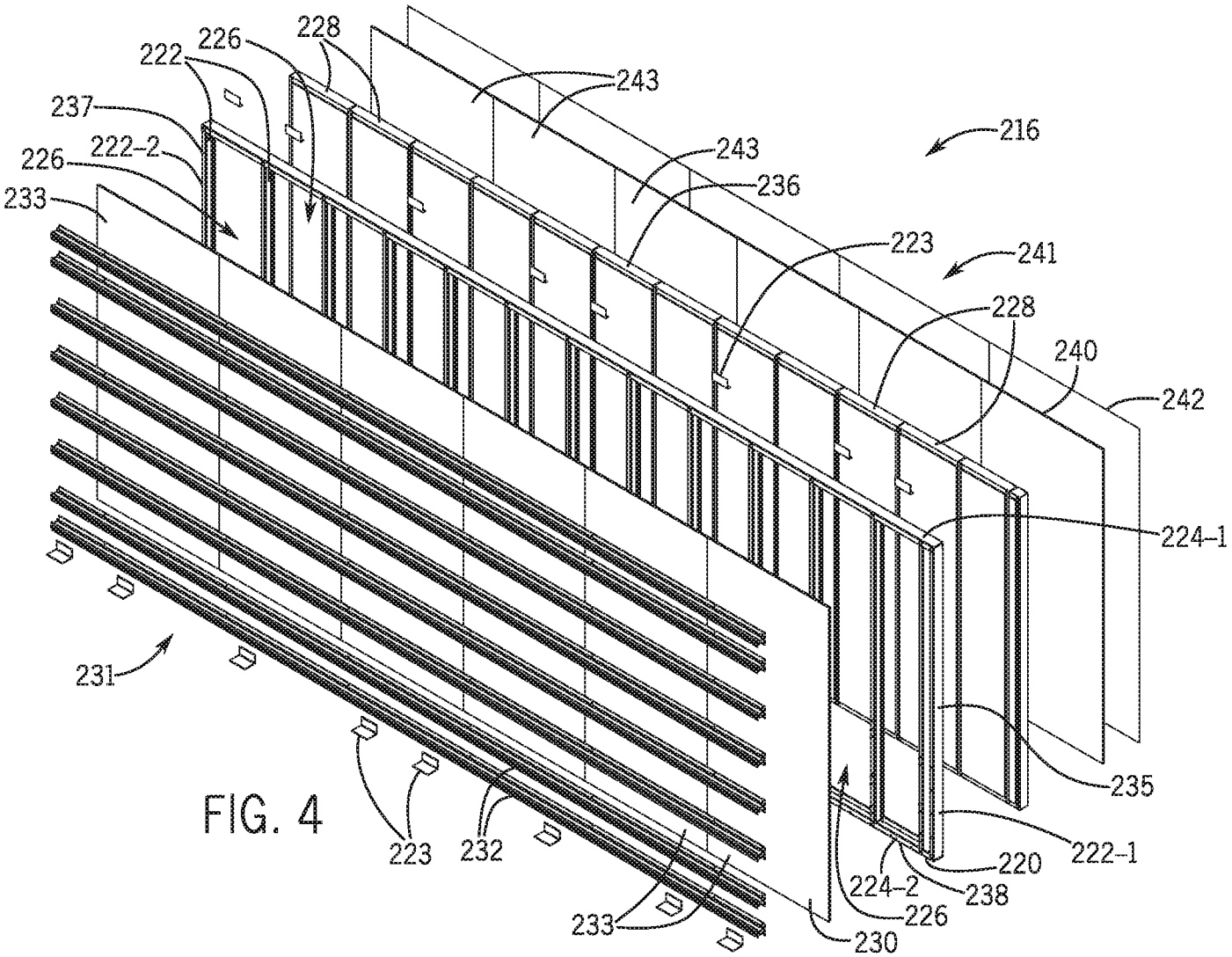
FIG. 4 shows a partially isometric exploded view of the pre-assembled wall panel in FIG. 3.

FIGS. 3 and 4 show an isometric view and a partially exploded isometric view, respectively, of a pre-assembled wall panel 216. The wall panel 216 may be used to implement one or more of the wall panels 116 of building 102. FIG. 3 shows wall panel 216, panel frame 220, outer stud 222-1, end member 224-1, first wall board 230, first major side 231 of wall panel 216 and second major side 241 of wall panel 216. FIG. 4 shows wall panel 216, panel frame 220, studs 222 including outer studs 222-1 and 222-2, end members, 224-1 and 224-2, wall cavities 226, insulation 228, first wall board 230, second wallboard 240, first major side 231 of wall panel 216 and second major side 241 of wall panel 216. The various components shown in FIGS. 3 and 4 are merely illustrative, and other variations, including eliminating components, combining components, and substituting components are all contemplated.

The wall panel 216 may include a panel frame 220 and first and second wall boards 230, 240, each attached to an opposite side of the panel frame 220. The panel frame 220 may include a plurality of studs 222. The studs 222 extend generally vertically and may thus be interchangeably referred to as vertical members. The studs 222 may be attached (e.g., welded, bolted, or adhered) to opposing end members 224-1 and 224-2. In some examples, one or more of the studs 222 may be integral with one or more of the end members 224-1, 224-2 (e.g., machined, cast, etc. as unitary component).

The outer studs 222-1 and 222-2 and the opposing end members 224-1 and 224-2 may define a perimeter portion of the panel frame 220. The outer studs 222-1 and 222-2 and the opposing end members 224-1 and 224-2 may collectively be referred to as perimeter members. Outer surfaces of the outer studs and opposing end members may define perimeter sides of the panel 216. The studs 222 may be generally parallel (e.g., plus or minus fifteen degrees) to one another. The studs 222 may be spaced apart and generally perpendicular (e.g., plus or minus fifteen degrees) relative to the end members 224-1, 224-2. In some examples, the end members 224-1 and 224-2 may be sufficiently long such that the wall panel 216 may span the full length of a unit. In some examples, the end members 224-1, 224-2 may be about 24 feet long. The end members 224-1, 224-2 may be shorter or longer than 24 feet in other examples, for example and without limitation 18 feet, 20 feet, 26 feet, 28 feet, etc. Generally, the length of the end members 224-1, 224-2 may be selected as may be appropriate for a particular building project. The studs 222 may be disposed in a spaced arrangement to define wall cavities 226. The studs 222 may be regularly or irregularly spaced. In some examples, insulation 228, such as mineral wool, may be provided in the wall cavities 226.

The panel frame 220 may be formed of metal, such as aluminum or steel. In some embodiments, the panel frame 220 may be formed of a non-metallic material, such as wood, plastic, or composite materials such as fiber reinforced composites. In some embodiments, the studs 222 may be formed of metal, such as aluminum or steel, for fire resistance, structural strength, weight reduction, or other factors. In some embodiments, the studs 222 may be formed of a non-metallic material, such as wood or plastic. In the illustrated example, the studs 222 and end members 224-1, 224-2 are formed of metal and have a C-shaped cross-section defined by flanges and web portions connecting opposing flanges. In other examples, the studs 222 may have different cross-sections. For example, the studs may be implemented using I-beams or box beams. One or more apertures may be formed in flanges or web portions, for example by punching or other known manufacturing techniques, e.g., for reducing the overall weight of panel 216 and or accommodating elements (e.g., conduits, wiring, insulation) extending into multiple adjacent wall cavities.

The wall panel 216 may include first and second wall boards 230 and 240 attached to opposite sides of the panel frame 220 to define first and second major sides 231 and 241, respectively, of the wall panel 216. In some examples, at least one of the major sides may provide an interior wall of a unit and may thus be referred to as an interior side. Another one of the major sides may provide an exterior wall and may thus be referred to as exterior side. In some examples both the first and second major sides provide interior walls, such as in the case of a demising wall, and may be referred to as first and second interior sides of the wall panel. The wall board 230 may include one or more pre-fabricated boards 233 of non-combustible material. The wall board 240 may include one or more pre-fabricated boards 243 of non-combustible material. In some examples, the pre-fabricated boards 233, 243 may include any of a variety of boards comprising inorganic mineral material such as cement board, magnesium oxide (MgO) board, gypsum board, any of which may include fibers reinforcing the core or reinforcing an exterior of the core (e.g., fiberglass- or metal-clad boards). Any of a variety of sheeting products using in the construction industry may be used to implement the boards 233, 243.

The wall panel 216 may include one or more mounting components (e.g., brackets 223). The mounting components may be disposed along the perimeter portion of the panel frame 220 and may be configured for attaching the wall panel 216 to other structure, such as the structural frame 104 of building 102. In some examples, the wall panel 216 may be used to construct, as examples and without limitation, a demising wall, an end wall, or a utility wall. In this regards, the wall panel 216 may be configured, without limitation, as a demising wall panel, an end wall panel, or a utility wall panel. In some examples, a wall panel 216 configured as a demising wall panel and may include one or more spacer components (e.g., brackets 232) along one or both of the major sides 231, 241. The spacer components may be positioned over an exterior surface of the wall board 230 and/or wall board 240. The spacer components may be configured for attaching interior finish elements associated with a unit. In other examples, a wall panel 216 may be configured as an end wall panel and may in such examples be configured to support interior finish elements on one of the major sides 231, 241, and further configured to support one or more exterior sheeting components (e.g., weather resistive barrier 242) on the other one of the major sides 231, 241.

The wall panel 216 may be provided with one or more waterproofing assemblies, as will be further described for example with reference to FIGS. 5-10. The waterproofing assemblies may be attached to the wall boards 230, 240 and/or panel frame 220 of the wall panel 216. A waterproofing assembly may extend along a perimeter side of the panel. In some examples, a waterproofing assembly may extend along the length (e.g., along a top or bottom perimeter side) or along a height (e.g., along a left or right perimeter side) of the panel. In some examples, the waterproofing assembly may extend along the full or substantially the full perimeter side. In some examples, a wall panel may include multiple waterproofing assemblies along multiple perimeter sides so as to substantially seal a wall panel and/or joints between adjoining wall panels against moisture intrusion. In some examples, a waterproofing assembly may include one or more components made from non-thermally-conductive materials (e.g., non-metallic materials) and/or having thermally-insulative properties (e.g., thermal insulation such as mineral wool or spray foam insulation) and may, therefore, also function as thermal insulators. In some examples, a waterproofing assembly may include an elongate member, which may be made from a non-metallic material, for example and without limitation a plastic material, a fiber-reinforced plastic, or other composite materials. Components of waterproofing assemblies in accordance with the present disclosure, such as those formed of plastic or FRP may be easily manufactured in various lengths using extrusion or pultrusion techniques.

When installed in a building, such as building 102, the top and bottom perimeter sides of a wall panel may be generally horizontal, thus waterproofing assemblies extending along the top and bottom perimeter sides may be referred to as horizontal waterproofing assemblies. The left and right perimeter sides may be generally vertical and thus waterproofing assemblies extending along the left and right perimeter sides may be referred to as vertical waterproofing assemblies.

Figure 5A:
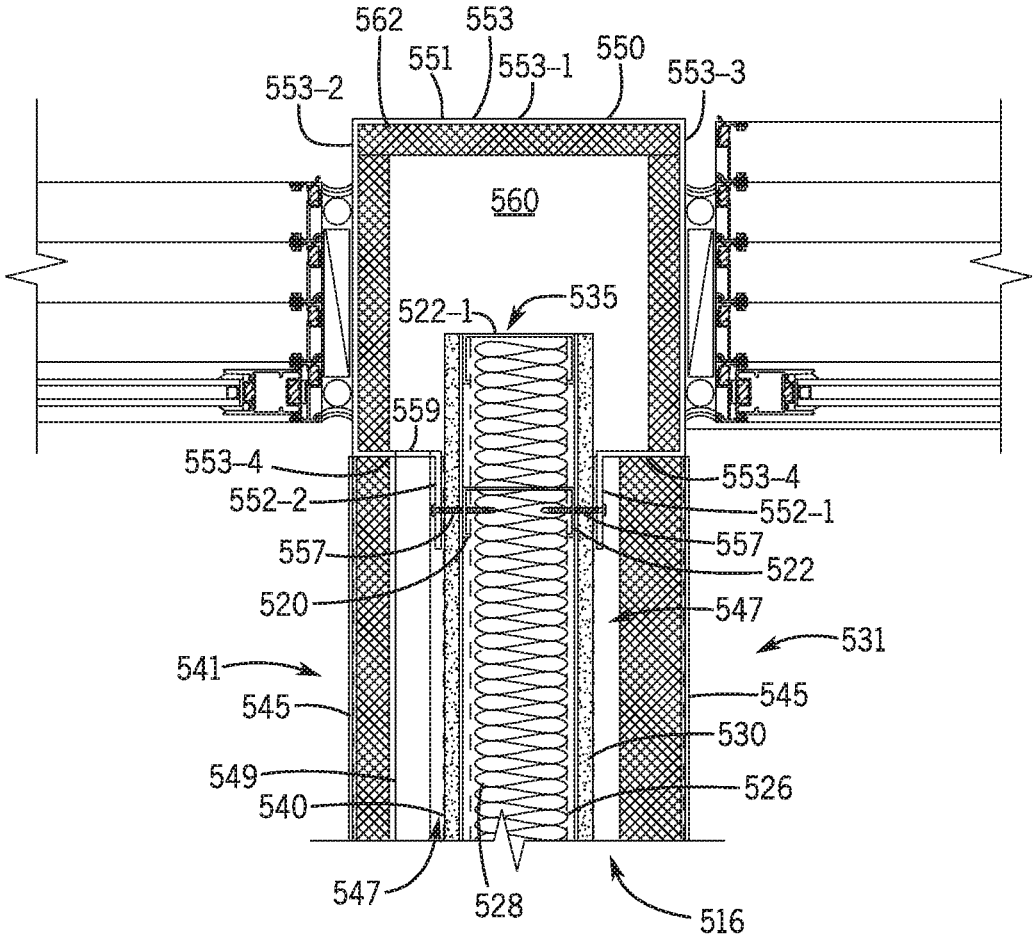
FIG. 5A shows a cross-section of waterproofing assembly in accordance with some examples of the present disclosure.
Figure 5B:
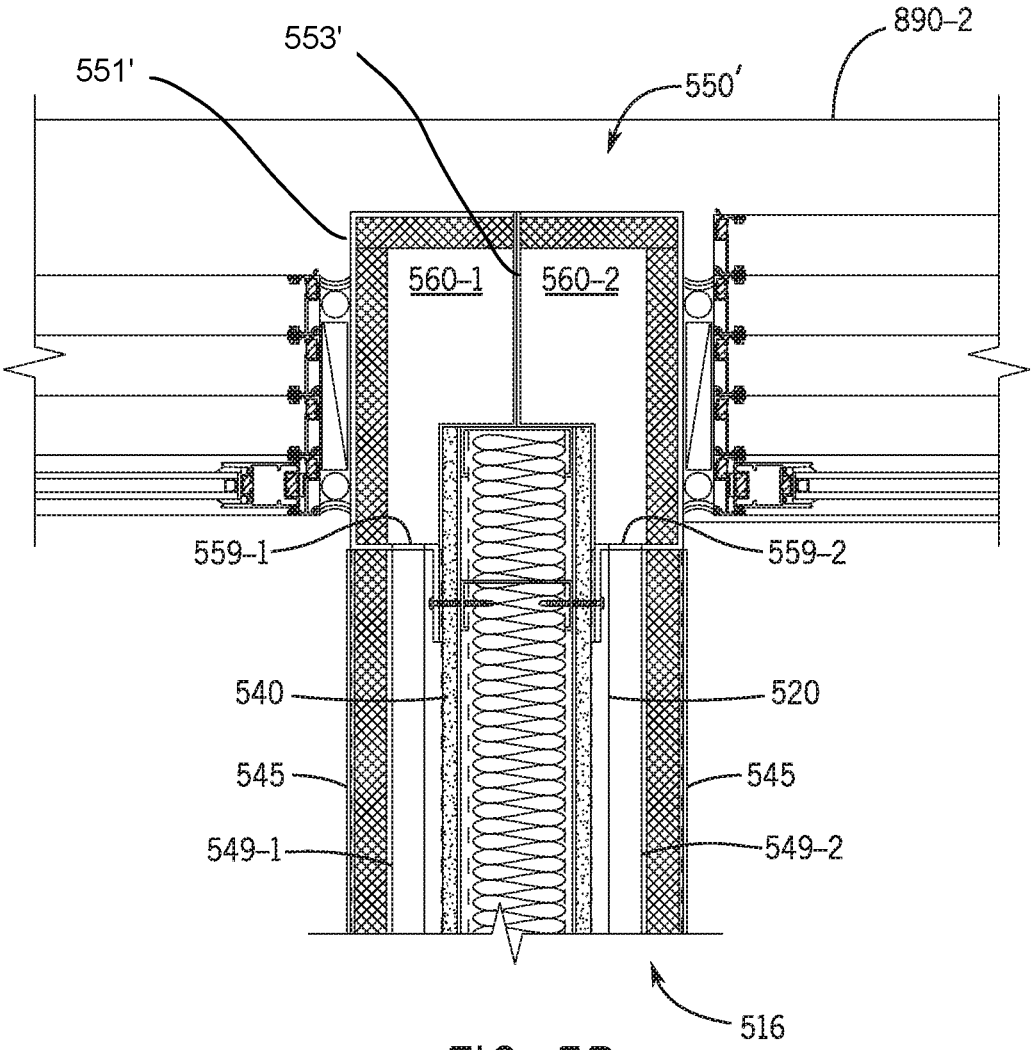
FIG. 5B shows a cross-section of waterproofing assembly in accordance with further examples of the present disclosure.

FIGS. 5A and 5B show cross-sections of waterproofing assemblies 550, 550' in accordance with some examples of the present disclosure. FIG. 5A shows waterproofing assembly 550, a portion of wall panel 516, panel frame 520, studs 522 and 522-1, wall cavity 526, insulation 528, wall boards 530 and 540 on major sides 531 and 541, respectively. FIG. 5B shows waterproofing assembly 550', a portion of wall panel 516, panel frame 520, studs 522 and 522-1, wall cavity 526, insulation 528, wall boards 530 and 540 on major sides 531 and 541, respectively. The various components shown in FIGS. 5A and 5B are merely illustrative, and other variations, including eliminating components, combining components, and substituting components are all contemplated.

The wall panel 516 may be used to implement one or more of the wall panels 116 in a building such as building 102, such as panel 111 as an example. The components illustrated in FIG. 5A may be used to implement the interface between adjoining wall panels of building 102, for example at the interface indicated with detail line 5-5 in FIG. 2. The wall panel 516 may include one or more of the components of wall panel 216, which may be indicated using similar reference numbers and the description of which may not be repeated. The wall panel 516 may include a panel frame 520 and wall boards 530 and 540 attached to the panel frame 520. The wall boards 530 and 540 may be formed using one or more pre-fabricated boards of non-combustible material.

The panel frame 520 may include a plurality of spaced studs 522. The studs 522 may be regularly or irregularly spaced along the length of the wall panel 516. The studs 522 may be connected to first and second opposing end members to define one or more wall cavities 526. Insulation 528 may be provided within the wall cavities 526. Wall boards 530 and 540 may be attached to opposite sides of the panel frame 520 and may define first and second major sides 531, 541, respectively, of the wall panel 516. The outer studs (only one outer stud is shown in this partial view) and end members may define a perimeter portion of the panel frame 520. For example, outer stud 522-1 may define a perimeter side 535 of the panel frame 520. The outer studs and end members may thus be interchangeably referred to as perimeter members. When assembled into a building, such as building 102, the perimeter side 535 may extend vertically (e.g., along the elevation direction of the building). The perimeter side 535 may thus be interchangeably referred to as a vertical perimeter side 535.

A waterproofing assembly 550 may be disposed along the perimeter side 535. The waterproofing assembly 550 may substantially enclose the perimeter side 535 and perimeter edges of the wall boards 530 and 540. A waterproofing assembly 550 may include an elongate member 551. The elongate member 551 may be a continuous member that extends the full length, which may in some examples be about 24 feet, or the full height, which may in some examples be about 9 feet, of a wall panel such as wall panel 516. In the illustrated example, the waterproofing assembly 550 is arranged along a vertical perimeter side of the wall panel 516 and the elongate member 551 may thus extend the full or part of the height of the wall panel 516. The elongate member 551 may be formed from a plastic, a fiber reinforced plastic (FRP), or a composite material (e.g., a fiber reinforced resin). The elongate member 551 may be formed in suitable lengths using a variety of manufacturing techniques, such as pultrusion, extrusion, molding, casting or a variety of automated composite manufacturing techniques such as automated tape laying (ATL) or automated fiber placement (AFP) techniques. In some examples, the elongate member 551 may be formed using additive manufacturing (e.g., 3D printing) techniques.

The elongate member 551 may include walls 553-1 to 553-4 which define a cavity 560 therebetween. For example, the elongate member 551 may include first wall 553-1 which is opposite and spaced from the perimeter member 535. The elongate member 551 may include second and third walls 553-2, 553-3 adjacent the first wall 553-1. The second and third walls 553-2, 553-3 may extend generally perpendicularly (e.g., plus or minus 15 degrees) to the first wall 553-1. The elongate member 551 may include fourth partial walls 553-4, which may terminate at flanges 552-1 and 552-2. The specific arrangement of the walls 553-1 to 553-4 may be changed as may be appropriate for a particular joint in a giving building project. The flanges 552-1 and 552-2 may be generally opposite one another and each may abut an exterior surface of a wall board. That is, the flange 552-1 may be positioned against the exterior surface of wall board 530 and the flange 552-2 may be positioned against the exterior surface of wall board 540. The waterproofing assembly 550 may be attached to the wall boards 530, 540 and/or panel frame 520 using the flanges 552-1 and 552-2 such as by using mechanical fasteners 557 (e.g., threaded fasteners, or rivets) that pass through respective flanges and wall boards and which terminate in a stud below a respective wall board.

The waterproofing assembly 550 may include insulative material 562 (e.g., mineral wool or spray insulation) inside the cavity 560. For example, one or more of the walls 553-1 to 553-4 may be lined with rigid mineral wool. In some examples, the waterproofing assembly 550 may include insulative material 562 along at least two of the walls of the elongate member 551, and in some examples along three of the walls (e.g., walls 553-1, 553-2, and 553-3) of the elongate member 551. In some examples, the waterproofing assembly 550 may include insulative material 562 along all of the walls 553-1 to 553-4 of the elongate member 551.

The wall panel 516 may be configured to function as a demising wall panel (e.g., demising wall panel 111 in FIG. 2). The wall panel 516 may be configured to support interior finish elements, such as interior finish panels 545. In some examples, the interior finish panels 545 may be spaced apart from the wall boards 530 and 540, for example using spacer components (e.g., brackets 232 of panel 216 in FIG. 2). In some examples, one or more of the walls 553 of the elongate member 551 may be configured to substantially align with a finish panel 545. For example, opposing second and third walls 553-2 and 553-3 may define a distance therebetween which may substantially correspond to a distance between the finish panels 545. In some examples, the overall width of the elongate member 551 may be greater than the distance between the exterior surfaces of the wall boards 530 and 540.

The spacer components may provide the finish panels 545 in a spaced relation to the wall boards 530, 540 thereby defining a space 547 between the wall boards 530, 540 and respective ones of the finish panels 545. The spaces 547 may accommodate additional components of the wall panel 516, for example and without limitation, conduits (e.g., electrical, optical and other types of conduits), ducts (e.g., an air duct 549), pipes (e.g., fire suppression pipes), sound-insulative and/or thermally-insulative materials. The air duct 549 may be connected to interior mechanical systems, such as a bathroom fan or a dryer vent, and may be used to vent air from the interior conditioned space of a unit to the exterior of the building envelope. For example, the elongate member 551 may include an inlet aperture 559 in one of the partial walls 553-4 and the air duct 549 may be fluidly connected to the cavity 560 via the inlet aperture 559. One or more outlet apertures, for example in the form of perforations or louvered openings, may be formed in one or more of the other walls (e.g., 553-1, 553-2 and/or 553-3) for venting air to the exterior of the building envelope.

The wall panel 516 and waterproofing assembly 550' in the example illustrated in FIG. 5B may be substantially similar to the wall panel 516 and waterproofing assembly 550 in the example in FIG. 5A, except that the waterproofing assembly 550' may define multiple cavities 560-1, 560-2 each having a corresponding inlet apertures 559-1, 559-2 fluidly connected to a respective one of the air duct 549-1, 549-2. The waterproofing assembly 550' may similarly include at least one elongate member 551' (e.g., FRP pultrusion). The elongate member 551' may include an interior wall 553' separating the interior of the elongate member 551' into the cavities 560-1 and 560-2. The two cavities 560-1 and 560-2 may alternatively be defined using two separate elongate members defining halves of the elongate member 551' and attached to opposite sides of the wall panel. The two elongate members may abut one another and each may be connected to a respective one of the air duct 549-1, 549-2.

Figure 6:
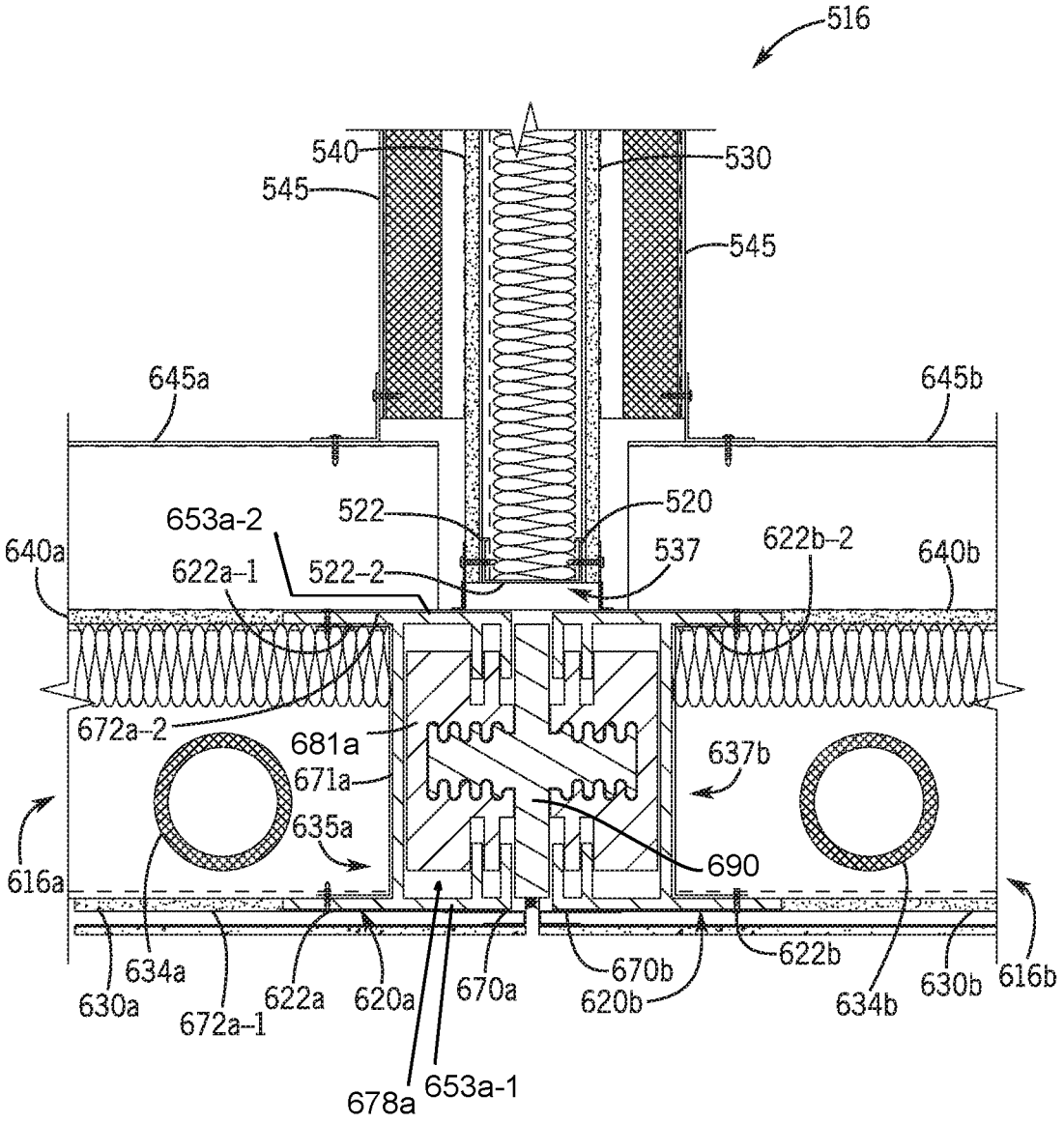
FIG. 6 shows a cross-section of adjoining waterproofing assemblies at an interface between adjoining wall panels in accordance with some examples of the present disclosure.

FIG. 6 shows a cross-section of waterproofing assemblies 670*a* and 670*b* provided at an interface between adjoining panels 616*a* and 616*b* in accordance with some examples of the present disclosure. FIG. 6 shows portions of wall panels 516, 616*a* and 616*b*, panel frames 520, 620*a* and 620*b*, wall boards 530, 540 of wall panel 516, and wall boards 630*a*, 640*a* and 630*b*, 640*b* of wall panel 616*a* and 616*b*, respectively. FIG. 6 further shows interior finish panels 545, 645*a*, and 645*b*, studs 522, 622*a*, and 622*b*, perimeter sides 537, 635*a*, and 637*b*, and waterproofing assemblies 670*a* and 670*b*. FIG. 6 shows a joint between the wall panels. The various components shown in FIG. 6 are merely illustrative, and other variations, including eliminating components, combining components, and substituting components are all contemplated.

The wall panels 616*a* and 616*b* may be used to implement one or more of the wall panels 116 in building 102, such as adjoining utility wall panels 117. The components illustrated in FIG. 6 may be used to implement an interface between adjoining wall panels of building 102, such as at the interface indicated with detail line 6-6 in FIG. 2. The wall panel 616*a* and 616*b* may include one or more of the components of wall panel 216, which may be indicated using similar reference numbers and the description of which may not be repeated. For example, each of the wall panels 616*a*, 616*b* may include a panel frame 620*a*, 620*b*. Wall boards 630*a* and 640*a* may be attached to the panel frame 620*a* of wall panel 616*a* and wall boards 630*b*, 640*b* may be attached to the panel frame 620*b* of wall panel 616*b*. The wall boards may be formed using one or more pre-fabricated boards of non-combustible material. The panel frames 620*a* and 620*b* may include studs 622*a*, 622*b*, respectively. Outer studs may define perimeter sides of the panel frames. For example, outer stud 622*a*-1 may define a first perimeter side 635 of panel frame 620*a*. The panel 616 may include another outer stud (not visible in this partial view) at the opposite perimeter side of the panel frame 620*a*. Similarly, the panel 616*b* may include first and second outer studs which may define first and second opposite perimeter sides of the panel frame 620*b* (only one outer stud 622*b*-2 and one perimeter side 637*b* is visible in this partial view).

The wall panels 616*a*, 616*b* may be configures as utility wall panels, and may be used to implement a utility wall of a building such as building 102. In this regards, the wall panels may include one or more plumbing components 634*a*, 634*b* (e.g., water and sewer lines). The walls panels 6161, 616*b* may support finish elements, for example interior finish panels 645*a* and 645*b* on one or both of the major sides of the wall panels 616*a*, 616*b*. The finish element (e.g., interior finish panels 645*a* and 645*b*) may be attached to respective ones of the wall panels 616*a* and 616*b* in a spaced arrangement relative to respective wall boards 640*a* and 640*b*. In some examples, the finish element (e.g., interior finish panels 645*a* and 645*b*) may not be spaced from the wall boards 640*a* and 640*b*.

When assembled in a building, the perimeter sides 635*a* and 637*b* may be arranged vertically (e.g., along an elevation direction of the building). The waterproofing assemblies 670*a*, 670*b* may be arranged at the vertical interface between adjoining wall panels and may extend substantially the full height of the wall panels, such as along the full length of the perimeter sides 635*a*, 637*b*. In some examples, a plurality of waterproofing assemblies may be arranged contiguously along the height of the wall panels to define the vertical interface between the wall panels.

The waterproofing assembly 670*a* may be disposed along the perimeter side 635. The waterproofing assembly 670*a* may substantially enclose the perimeter side 635 and perimeter edges of the wall boards 630*a* and 640*a*. The waterproofing assembly 670*a* may include one or more elongate members, which may extend a part of or substantially the full height of the wall panel 616*a*. One or more of the elongate members may be continuous member that extend a full length of a perimeter side, such as the full height of the wall panel. In some examples, the elongate members may be about 8 feet long. In some examples, the elongate members may be longer than 8 feet, for example 12 feet, 14 feet, 16 feet or more. In some examples, the elongate members maybe longer than 20 feet, such as when a wall panel spans, at least partially, two stories of a building. One or more of the elongate members may be formed from a plastic, a fiber reinforced plastic (FRP), or a composite material (e.g., a fiber reinforced resin). The elongate members may be formed in suitable lengths using a variety of manufacturing techniques, such as pultrusion, extrusion, molding, casting, a variety of automated composite manufacturing techniques such as automated tape laying (ATL) or automated fiber placement (AFP) techniques, or additive manufacturing techniques (e.g., 3D printing).

The waterproofing assembly 670*a* may include a first elongate member 671*a* and a second elongate member 681*a* received, at least partially within a cavity 678*a* of the first elongate member 671*a*. The second elongate member 681*a* may be movably coupled to the first elongate member 671*a*. In some examples, the second elongate member 681*a* may be movable in the transverse direction (e.g., along the thickness of wall panel 616*a*) which may reduce the severity in tolerances during manufacture and facilitate alignment of the wall panels 616*a* and 616*b* during assembly. The second elongate member 681*a* may be movable in the cavity up to about ½ inch, and in some examples up to about 1 inch in the transverse direction. In some examples, the second elongate member 681*a* may be movable transversely by more than 1 inch. The first elongate member 671*a* may include walls 653*a*-1 and 653*a*-2 which terminate at flanges 672*a*-1 and 672*a*-2. The waterproofing assembly 670*a* may be attached to the panel frame 620*a* and/or wall boards 630*a*, 640*a* using the flanges 672*a*-1 and 672*a*-2. The flanges 672*a*-1 and 672*a*-2 may abut exterior surfaces of the wall boards 630*a*, 640*a*.

The waterproofing assembly 670*b* may be disposed along the perimeter side 637*b* of wall panel 616*b*. The waterproofing assembly 670*b* may substantially enclose the perimeter side 637*b* and perimeter edges of the wall boards 630*b* and 640*b*. The waterproofing assembly 670*b* may be substantially a mirror image of the waterproofing assembly 670*a* and for brevity the description thereof will not be repeated. Each of the waterproofing assemblies 670*a* and 670*b* may be configured to engage a sealing member 690.

The sealing member 690 may be provided between the waterproofing assemblies 670*a* and 670*b* and may include features for interlocking with corresponding features of each of the waterproofing assemblies 670*a* and 670*b*. In some examples, the sealing member 690 may be attached to one of the wall panels 616*a* or 616*b* before the wall panel is delivered to the job side, so as to reduce the number of separate components that may be delivered to the job site and/or reduce the time in locating mating components. For example, the pre-assembled wall panel 616*a* may include the sealing member 690 engaged with the second elongate member 681*a* when it arrives on the job site. The panel 616*b* to be joined thereto may not include a sealing member. The panel 616*b* may be moved towards the panel 16*a* to cause the sealing member 690 to engage (e.g., to interlock) with the waterproofing assembly 670*b* of the panel 616*b*. The two panels 616*a* and 616*b* may then be attached to the building structural frame. In other examples, the sealing member 690 may instead be attached to the wall panel 616*b* and a similar assembly sequence may be used to join the two panels 616*a*, 616*b* to one another and to the structural frame. In yet further examples, the first wall panel 616*a* may first be jointed to the structural frame and/or other components of the building before panel 616*b* is joined to panel 616*a*. In some examples, the sealing member 690 may be separate from the wall panels and may be attached to a wall panel during the joining of the wall panel to the building.

As will be appreciated, the waterproofing assemblies 670*a* and 670*b* of respective ones of wall panels 616*a* and 616*b* may be one or a plurality of waterproofing assemblies of each of the panels. In some examples, the opposite sides of each of the wall panels 616*a* and 616*b* from those illustrated in FIG. 6 may be provided with another waterproofing assembly which may be a mirror image of the one illustrated in FIG. 6. In some examples, the opposite side of either one of the wall panels 670*a* or 670*b* may include a modified waterproofing assembly, such as described further below with reference to FIG. 8, for example where two adjoining panels are arranged perpendicular to one another, such as the edge of a building.

Figure 7:
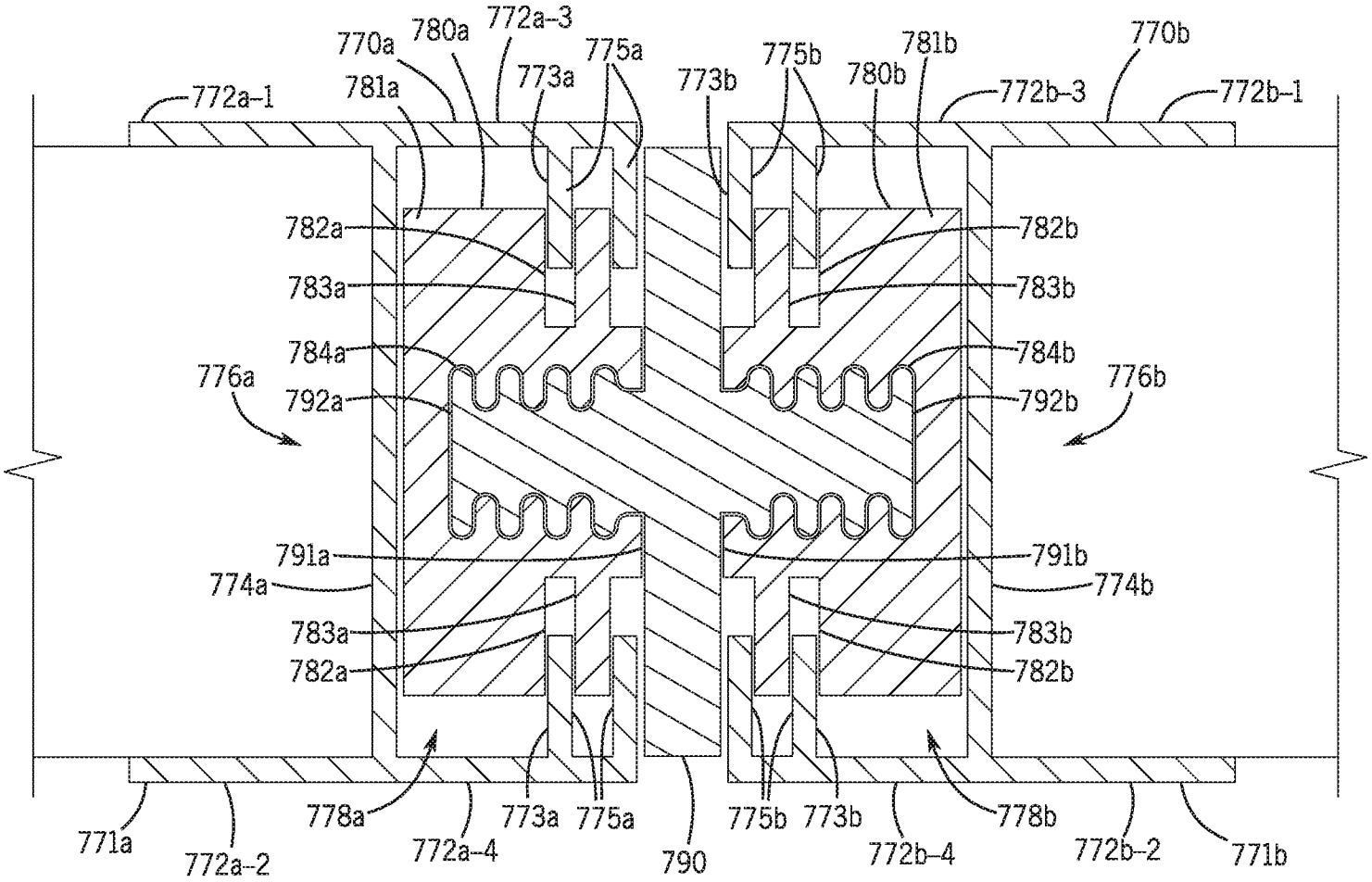
FIG. 7 illustrates a partial view of adjoining waterproofing assemblies in accordance with some examples of the present disclosure.

FIG. 7 illustrates a partial view of adjoining waterproofing assemblies in accordance with some examples of the present disclosure. FIG. 7 shows first and second waterproofing assemblies 770*a*, 770*b*, flanges 772*a*-1 through 772*a*-4 and 772*b*-1 through 772*b*-4, channels 776*a* and 776*b*, cavities 778*a* and 778*b*, inserts 780*a* and 780*b*, and sealing member 790 engaged with the inserts 780*a* and 780*b*. The various components shown in FIG. 7 are merely illustrative, and other variations, including eliminating components, combining components, and substituting components are all contemplated.

The waterproofing assemblies 770*a* and 770*b* may be used to implement the waterproofing assemblies 670*a* and 670*b*, respectively. The waterproofing assembly 770*a* may be attached to a panel frame and/or wall boards of a wall panel, such as wall panel 616-1 in FIG. 6 or another wall panel 116 of the building 102. The waterproofing assembly 770*b* may be attached to a panel frame and/or wall boards of another wall panel, such as wall panel 616-2 in FIG. 6 or another wall panel 116 of the building 102. The waterproofing assemblies 770*a* and 770*b* may be provided at the interface between adjoining wall panels so as to substantially seal the interface against water intrusion. For example, each of the waterproofing assemblies may engage a sealing member 790 (e.g., gasket). In some examples, the waterproofing assemblies 770*a* and 770*b* may further provide thermal insulation so as to reduce heat transfer between the adjoining panels and/or between conditioned and unconditioned spaces of the building. As described herein, the wall panels may be attached to the structural frame using mounting components. Thus, although the waterproofing assemblies 770*a* and 770*b* may each engage a sealing member, the interface between adjoining wall panels provided with waterproofing assemblies 770*a* and 770*b* may be substantially non-load bearing.

Waterproofing assembly 770*a* may include an elongate member 771*a* having a generally I-shaped cross section defined by the flanges 772*a*-1 through 772*a*-4 and web 774*a*. Flanges 772*a*-1 and 772*a*-3 may extend in opposite directions from one side of the web 774*a* and flanges 772*a*-2 and 772*a*-4 may extend in opposite directions from the other side of web 774*a* to define upper and lower walls of the elongate member 771*a*. The waterproofing assembly 770*a* may be configured to be attached to a panel frame and/or wall boards of a wall panel using opposing flanges 772*a*-1 and 772*a*-2. For example, the flanges 772*a*-1 and 772*a*-2 and web 774*a* may define a generally U-shaped channel which receives a perimeter side of a wall panel. The flanges are configured to abut respective exterior surfaces of the wall boards of a wall panel. The waterproofing assembly may be attached thereto using conventional fastening techniques, such as mechanical fasteners joining respective ones of the flanges 772*a*-1 and 772*a*-2 to a respective wall board and/or underlying panel frame. In other examples, the waterproofing assembly may be bonded to the wall boards and/or the perimeter portion of the panel frame.

The flanges 772*a*-3 and 772*a*-4 define a cavity 778*a* on the opposite side of the web 774*a* from the U-shaped channel 776*a*. The cavity 778*a* may be configured to receive an insert 780*a* which may be operably arranged to engage a sealing member 790 (e.g., a gasket). For example, the flanges 772*a*-3 and 772*a*-4 may include retention features configured to engage corresponding retention features of the insert 780*a*. For example, each of the flanges 772*a*-3 and 772*a*-4 may include a rim portion 773*a* which operably engages a ledge portion 782*a* of the insert 780*a*. The rim portion 773*a* may be implemented as a protrusion extending inwardly from a respective flange towards the cavity 778*a*. In some examples, the rim portion 773*a* may include a plurality of rim walls 775*a* configured to receive a projection 783*a* of the insert 780*a*. The insert 780*a* may be implemented using an elongate member, such as an elongate member formed of water impervious and optionally thermally insulating material. In some examples, the insert 780*a* may be an FRP pultrusion.

The waterproofing assembly 770*b* may be similarly configured. The waterproofing assembly 770*b* may be a mirror image of the waterproofing assembly 770*a*. The waterproofing assembly may also include a first elongate member 771*b* and a second elongate member 781*b* functioning as an insert received in a cavity defined by the first elongate member 771*b*. The first elongate member 771*b* may have a generally I-shaped cross section defined by the flanges 772*b*-1 through 772*b*-4 and web 774*b*. The flanges 772*b*-1 and 772*b*-3 may extend in opposite directions from a first side of the web 774*b* and the flanges 772*b*-2 and 772*b*-4 may extend in opposite directions from a second opposite side of the web 774*b* defining upper and lower walls of the waterproofing assembly 770*b*. The waterproofing assembly 770*b* may be configured to be attached to a panel frame and/or wall boards of a wall panel using opposing flanges 772*b*-1 and 772*b*-2. The flanges 772*b*-1 and 772*b*-2 and web 774*b* may define a generally U-shaped channel which receives a perimeter side of a wall panel. The flanges 772*b*-1 and 772*b*-2 may be configured to abut respective exterior surfaces of the wall boards of a wall panel. The waterproofing assembly 770*b* may be attached thereto using conventional fastening techniques, such as mechanical fasteners or adhesive.

The flanges 772*b*-3 and 772*b*-4 may define a cavity 778*b* on the opposite side of the web 774*b* from the U-shaped channel 776*b*. The cavity 778*b* may be configured to receive an insert 780*b* which may be configured to engage a gasket 790. In some examples, the flanges 772*b*-3 and 772*b*-4 may include retention features (e.g., rim portions 773*b* and/or rim walls 775*b*) configured to engage corresponding retention features (e.g., ledge 782*b* and/or projection 783*b*) of the insert 780*b*.

The inserts 780*a* and 780*b* may be configured to engage opposite sides of the sealing member 790. In some examples, the sealing member 790 may include an interlocking feature on each of its major sides 791*a* and 791*b* for mating with corresponding interlocking features of the inserts 780*a* and 780*b*. In the illustrated example, the sealing member 790 includes ribbed projections 792*a*, 792*b*, each configured to be received in a respective ribbed trench 784*a*, 784*b* of the respective insert 780*a*, 780*b*. In other examples, the location of one or more of the ribbed projections and corresponding ribbed trenches may be reversed, such as by providing on or more of the ribbed projections on the insert for insertion into a ribbed trench of a sealing member. In other examples, the interlocking features may be implemented using a plurality of projections and trenches. Other arrangements and combinations may be used in yet further examples.

Figure 8:
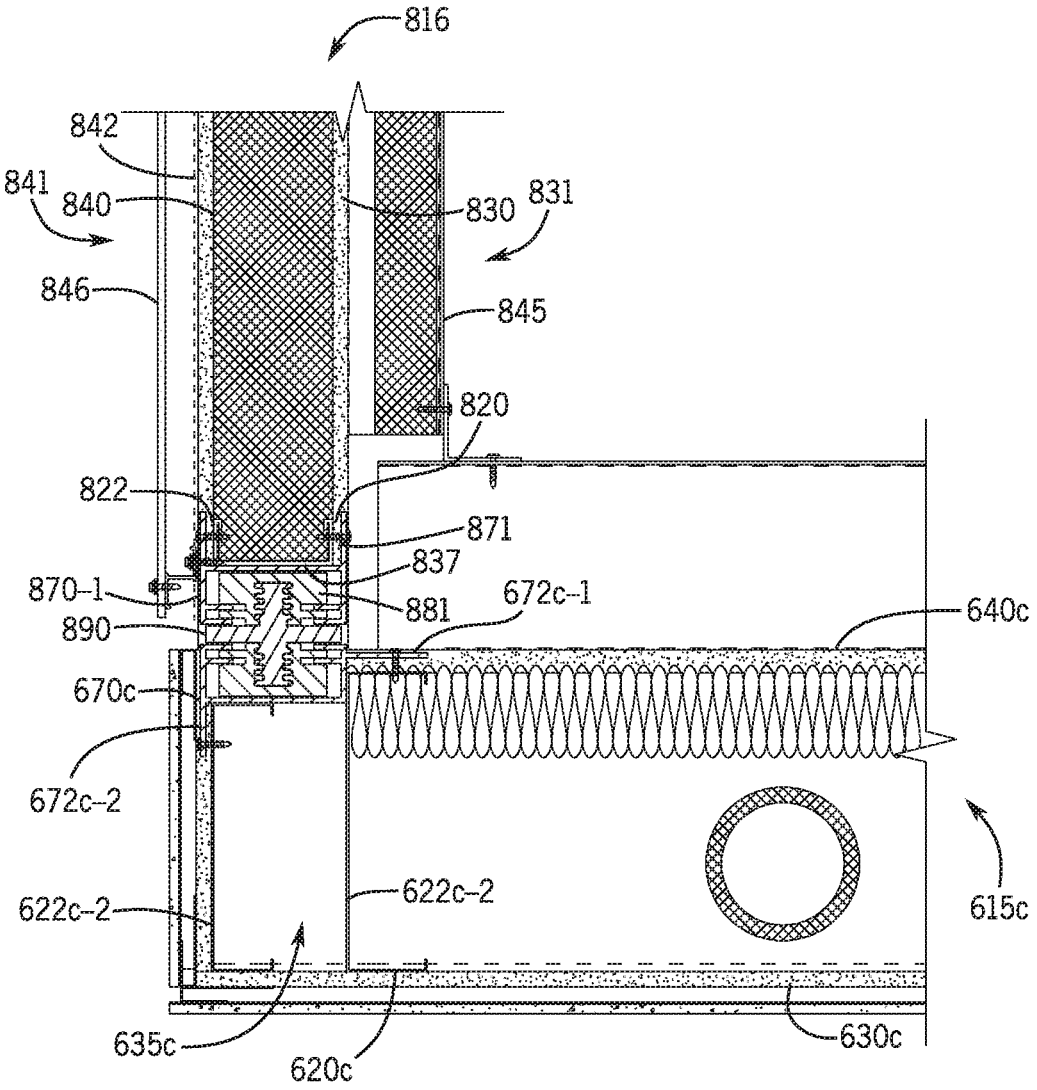
FIG. 8 shows a cross-section of adjoining waterproofing assemblies at an interface between adjoining wall panels in accordance with further examples of the present disclosure.

FIG. 8 shows a cross-section of an interface between adjoining wall panels and waterproofing assemblies thereof, in accordance with further examples of the present disclosure. FIG. 8 shows wall panels 816 and 616*c*, panel frames 820 and 620*c*, wall boards 830 and 840 of panel 816 and wall boards 630*c* and 640*c* of panel 616*c*, outer studs 622*c*-2 and 622*c*-3 and waterproofing assemblies 870-1 and 670*c*. The various components shown in FIG. 8 are merely illustrative, and other variations, including eliminating components, combining components, and substituting components are all contemplated.

The wall panels 616*c* and 816 may be used to implement one or more of the wall panels 116 in building 102, such as adjoining utility wall panel 117 and an end wall panel 113, respectively. For example, the components illustrated in FIG. 8 may be used to implement an interface between adjoining wall panels of building 102, such as at the interface indicated with detail line 8-8 in FIG. 2.

The wall panel 816 may include one or more of the components of wall panel 216, which may be indicated using similar reference numbers and the description of which may not be repeated. For example, the wall panel 816 may include a panel frame 820 and wall boards 830 and 840 attached to opposite sides of the panel frame 820. The wall boards 830 and 840 may be formed using one or more pre-fabricated boards of non-combustible material. The panel frame 820 may include a plurality of studs and the outer studs may define perimeter sides of the panel frame 820. For example, the panel frame 820 may include an outer stud 822-2 at one side of the panel frame 820. The panel frame 820 may include another outer stud (e.g., as described further below with reference to FIG. 9) at the opposite side of the panel frame 820. When the wall panel 816 is installed in a building, the outer stud 822-2 may extend along the vertical direction (e.g., the height of wall panel 816) and may define a perimeter side 837. The waterproofing assembly 870-1 may be disposed along the perimeter side 837 and may substantially enclose the perimeter side 837 and respective perimeter edges of the wall boards 830, 840.

The wall panels 816 may be configured as an end wall panel (e.g., end wall panel 113 of building 102). In some examples, a first major side 831 of the wall panel 816, as defined by the wall board 830, may provide an interior wall of the building. In some examples, a second major side 841 of the wall panel 816, as defined by the wall board 840, may provide an exterior wall of the building. In such examples, the sides 831 and 841 may be interchangeably referred to as interior and exterior sides, respectively. In some examples, the wall panel 816 may be configured to support exterior finishing components (e.g., weather resistive barrier 842, exterior cladding 846) on the exterior side. The exterior cladding 846 may be attached to the wall panel 816 using conventional techniques, such as via girts (e.g., Z-shaped, U-shaped, or others) or furring channels. The wall panel 816 may be configured to support interior finishing components (e.g., interior finish panel 845) on the interior side. The interior finish panel 845 may be spaced apart from the wall board 830 using a spacer component (e.g., bracket 232 in FIG. 2).

The wall panel 816 may include a waterproofing assembly 870-1 along the perimeter side 837. The waterproofing assembly 870-1 may be similar to previously described waterproofing assemblies (e.g., waterproofing assemblies 670*a*, 670*b*, 770*a* and 770*b*), and similar features may be designated using similar reference numbers. In some examples, the waterproofing assembly 870-1 may be implemented using any of the waterproofing assemblies 770*a* or 770*b* described previously with reference to FIG. 7. For example, the waterproofing assembly 870-1 may include a first elongate member 871 and a second elongate member 881, one or more of which may be made from water impervious and/or thermally insulating materials. The second elongate member 881 may be configured to engage a sealing member 890, such as a rubber gasket.

The waterproofing assembly 870-1 may be one of a plurality of waterproofing assemblies attached to the wall panel 816. In some examples, the wall panel 816 may include a second waterproofing assembly 850, an example of which is described further with reference to FIG. 9. In further examples, the wall panel 816 may include a third waterproofing assembly 890-1, an example of which is described further with reference to FIG. 10.

Referring back to FIG. 8, the wall panel 616*c* may include one or more of the components of other wall panel described herein, and similar components may be indicated using similar reference numbers. For example, the wall panel 616*c* may include a panel frame 620*c* and wall boards 630*c* and 640*c* attached to opposite sides of the panel frame 620*c*. The wall boards 830 and 840 may be formed using one or more pre-fabricated boards of non-combustible material. The panel frame 620*c* may include a plurality of studs including studs 622*c*-2 and 622*c*-3 provided at a perimeter portion 635*c* of the panel frame 620*c*. The wall panel 616*c* may be arranged generally perpendicularly with respect to wall panel 816 with the perimeter portion 635*c* overlapping the perimeter side 837. The waterproofing assembly 670*c* may thus be generally perpendicular to the lengthwise direction of the wall panel 616*c*. As in other examples herein, the waterproofing assembly 670*c* may include a first elongate member 671*c* and a second elongate member 681*c* received in a cavity 678*c* defined by the first elongate member 671*c*. The waterproofing assembly 670*c* may be attached to the panel frame 620*c* and one or more wall boards of the wall panel 616*c* via flanges 672*c*-1 and 672*c*-2 of the first elongate member 671*c*.

As will be appreciated, the waterproofing assembly 670*c* may be one of a plurality of waterproofing assemblies of wall panel 616*c*. In some examples, the opposite side of wall panel 616*c* from the one illustrated in FIG. 8 may be provided with another waterproofing assembly such as waterproofing assembly 670*a* described previously with respect to FIG. 6. Each of the waterproofing assemblies 870-1 and 671*c* may be configured to engage a sealing member 890. The sealing member 690 may be disposed between the waterproofing assemblies 870-1 and 671*c* and may include features for interlocking with corresponding features of each of the waterproofing assemblies 870-1 and 671*c*. For example, the sealing member 890 may be implemented using the sealing member 790 described previously with reference to FIG. 7.

Figure 9:
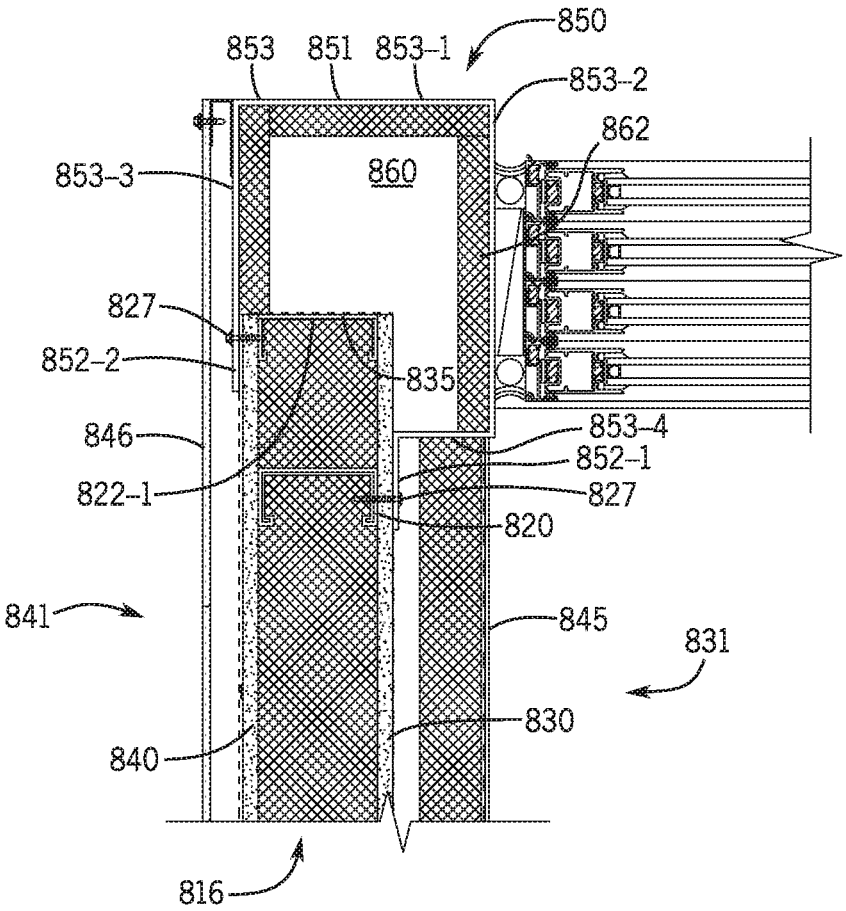
FIG. 9 shows a cross-section of a waterproofing assembly in accordance with further examples of the present disclosure.

FIG. 9 shows a cross-section of a waterproofing assembly in accordance with further examples of the present disclosure. FIG. 9 shows wall panel 816, panel frame 820, wall boards 830 and 840, and waterproofing assembly 850. The various components shown in FIG. 9 are merely illustrative, and other variations, including eliminating components, combining components, and substituting components are all contemplated.

The wall panel 816 may be used to implement one or more of the wall panels 116 in building 102, such as an end wall panel 113 adjoining window wall 115. For example, the components illustrated in FIG. 9 may be used to implement an interface between adjoining wall panels of building 102, such as at the interface indicated with detail line 9-9 in FIG. 2. FIG. 9 illustrates a side of wall panel 816 opposite to the side illustrated and described above with respect to FIG. 8. When the wall panel 816 is installed in a building, the outer stud 822-1 may extend along the vertical direction (e.g., the height of wall panel 816) and may define a perimeter side 835. The waterproofing assembly 850 may be disposed along the perimeter side 835 and may substantially enclose the perimeter side 835 and respective perimeter edges of the wall boards 830, 840.

The waterproofing assembly 850 may be disposed along the perimeter side 835. The waterproofing assembly 850 may substantially enclose the perimeter side 835 and perimeter edges of the wall boards 830 and 840. A waterproofing assembly 850 may include an elongate member 851, which may be a continuous member that extends the full vertical length of the wall panel 816 The elongate member 851 may be formed from a plastic, a fiber reinforced plastic (FRP), or a composite material (e.g., a fiber reinforced resin) using a variety of techniques such as extrusion, pultrusion, casting, molding, and automated fiber placement.

The elongate member 851 may include walls 853 which define a cavity 860 therebetween. For example, the elongate member 551 may include first wall 853-1 which is opposite and spaced from the perimeter side 835 of the panel frame 820. The elongate member 851 may include second and third walls 853-2, 853-3 adjacent the first wall 853-1. The second and third walls 853-2, 853-3 may extend generally perpendicularly (e.g., plus or minus 15 degrees) to the first wall 853-1. The elongate member 851 may include a fourth partial wall 853-4 which may extend generally perpendicularly to the second wall 853-2. The walls 853-3 and 853-4 may terminate at flanges 852-1 and 852-2. The specific arrangement of the walls 833 may be changed as may be appropriate for a particular joint in a giving building project. The flanges 852-1 and 852-2 may be provided against opposite sides of the wall panel 816 and may thus be said to be generally opposite to one another even if not strictly aligned. The flanges 852-1 and 852-2 may each abut an exterior surface of a wall board. That is, the flange 852-1 may be positioned against the exterior surface of wall board 830 and the flange 852-2 may be positioned against the exterior surface of wall board 840. The waterproofing assembly 850 may be attached to the wall boards 830, 840 and/or panel frame 820 using the flanges 852-1 and 852-2 for example using mechanical fasteners 857 (e.g., threaded fasteners, or rivets) that pass through respective flanges and wall boards and which terminate in a stud below a respective wall board.

The waterproofing assembly 850 may include insulative material 862 (e.g., mineral wool or spray insulation) inside the cavity 860. In some examples, the waterproofing assembly 850 may include insulative material 562 along two or more of the walls 853 of the elongate member 851, in some examples along all three of the walls and in some examples along all four walls. In some examples, insulation may not be provided along one of the walls, such as the fourth wall 853-4 which may be located in the interior of the building and thus within the condition space. In some examples, the overall width of the elongate member 851 may be greater than the distance between the exterior surfaces of the wall boards 830 and 840.

Figure 10:
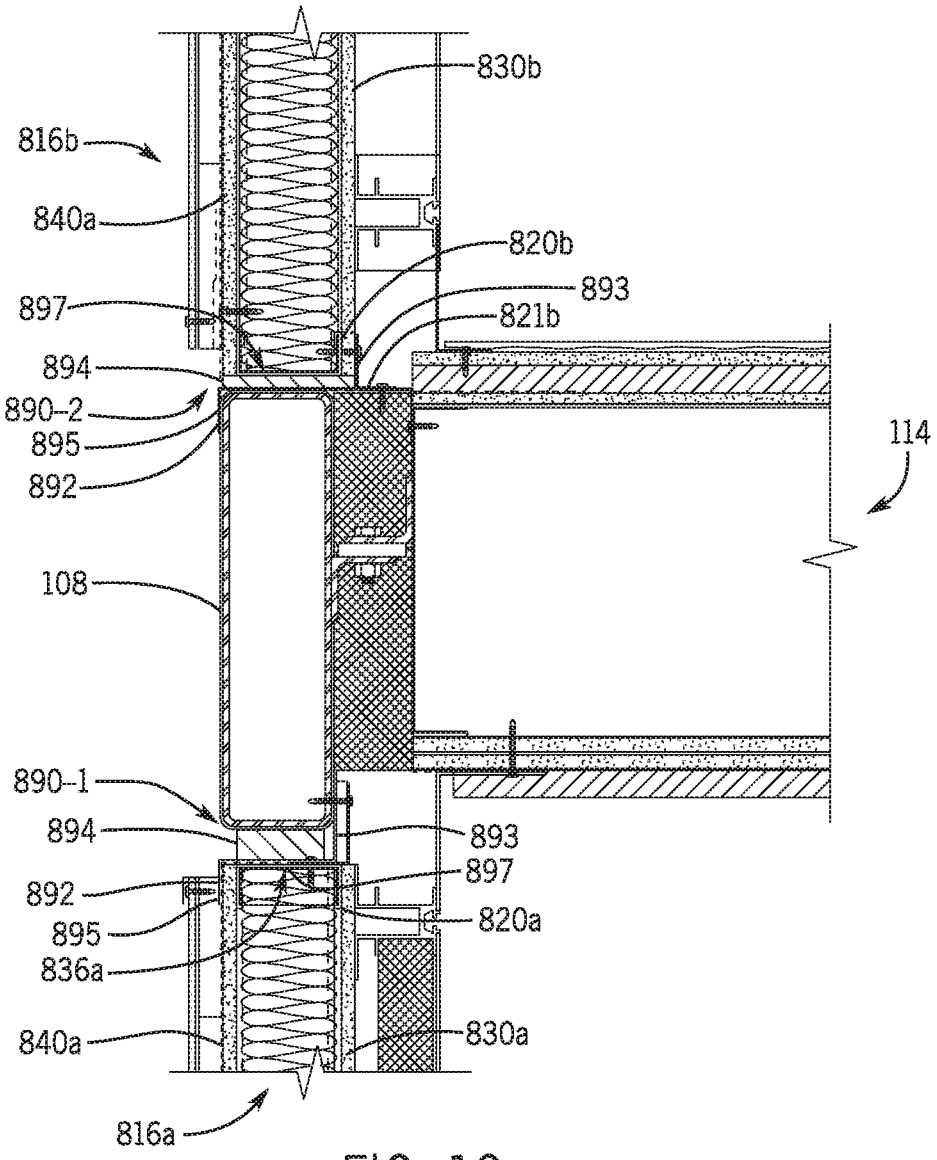
FIG. 10 shows a partial elevation cross-section of a floor-ceiling panel and upper and lower envelope walls.

FIG. 10 shows a partial cross-section of a floor-ceiling panel and adjoining envelope walls. FIG. 10 shows lower wall panel 816*a*, upper wall panel 816*b*, floor-ceiling panel 114, beam 108, and waterproofing assemblies 890-1 and 890-2. The various components shown in FIG. 10 are merely illustrative, and other variations, including eliminating components, combining components, and substituting components are all contemplated.

The floor-ceiling panel 114 may provide a ceiling for a lower story (e.g., story 103*a* of building 102) and a floor for an upper story (e.g., story 103*b* of building 102). The floor-ceiling panel 114 may be joined to the structural frame, e.g., to a beam 108. A wall panel 816*a*, only an upper portion of which is shown in this view, may be associated with the lower story and may be referred to as lower wall panel. A wall panel 816*b*, only a lower portion of which is shown in this view, may be associated with the upper story and may be referred to as upper wall panel. The wall panels 816*a* and 816*b* may be positioned over structural members of the building and may be joined to the structural frame and/or the floor-ceiling panel. For example, the upper wall panel 816*b* may be positioned over the beam 1108 and may be joined to the floor-ceiling panel 114 using a mounting component (e.g., angle bracket 821*b*). The lower wall panel 816*a* may be similarly arranged. That is, while not illustrated in this partial view, the lower portion of the lower wall panel 816*a* may also be positioned over a beam associated with the lower story and the wall panel 816*a* may extend between the lower beam and the upper beam (e.g., beam 108 in FIG. 10). The wall panels 816*a*, 816*b* may include one or more of the features of wall panels described herein and similar features may be indicated using similar reference numbers. For example, wall panel 816*a* may include a panel frame 820*a* and wall boards 830*a*, 840*a* attached to the panel frame 820*a*. Wall panel 816*b* may include a panel frame 820*b* and wall boards 830*b*, 840*b* attached to the panel frame 820*b*.

The wall panel 816*a* may be provided with a waterproofing assembly 890-1 attached to the panel frame 820*a* and/or wall boards 830*a*, 840*b* of the wall panel 816*a*. The waterproofing assembly 890-1 may extend along the full perimeter side 836*a* of the panel frame 820*a*. The waterproofing assembly 890-1 may include an elongate member 892 and a sealing member 894 (e.g., a gasket). The elongate member 892 may span the full horizontal length of the wall panel 816*a*. The elongate member 892 may be made from a water impervious material. The elongate member 892 may be configured to reduce or substantially prevent moisture intrusion through the interface between the wall panel and beam.

The elongate member 892 may have a generally Z-shaped cross-section defined by flanges 893 and 895 connected to web 897. The flanges 893 and 895 may extend generally perpendicularly in opposite directions from opposite ends of the web 897. After the installation of wall panel 816*a* and beam 108, the flange 895 may be arranged vertically downward against the exterior surface of wall board 840*a* and the flange 893 may be arranged vertically upward against an opposite surface of the beam 108. The flange 895 may be referred to as downward facing flange and the flange 893 may be referred to as upward facing flange. In some examples, the elongate member 892 may be made from a material which is also thermally insulating, for example a non-metallic material such as plastic or FRP, and may thereby additionally provide a thermal sealing function. The sealing member 894 may be formed of a resilient material and may be adhered to the upper surface of the elongate member 892. The sealing member 894 may extend along the full length of the elongate member 892. The Z shape of the elongate member 892 and sealing member 894 may effectively reduce or prevent moisture intrusion through the interface between the wall panel 816*a* and beam 108.

A waterproofing assembly 890-2 may be provided at the interface between the wall panel 816*b* and the beam 180. The waterproofing assembly 890-2 may include an elongate member 892 and a sealing member 894 (e.g., a gasket). The elongate member may span the full horizontal length of the wall panel 816*b*. The elongate member 892 may be made from a water impervious material. An upward facing flange 893 of the elongate member may prevent moisture intrusion through the interface between the wall panel and beam. After the installation of the beam 108 and wall panel 816*b*, the upward facing flange 893 may be provided against a surface of the wall board 830*b*.

In some examples, the elongate member 892 may be made from a material which is also thermally insulating, for example a non-metallic material such as plastic or FRP, and may thereby additionally provide a thermal sealing function. The sealing member 894 may be formed of a resilient material and may be adhered to the upper surface of the elongate member 892. The sealing member 894 may extend along the full length of the elongate member 892.

In some examples, the waterproofing assembly 890-2 may be disposed on the beam and the upper wall panel 816*b* may be placed over the waterproofing assembly 890-2. When the wall panel 816*b* is joined to the floor-ceiling panel, the sealing member 894 may be compressed forming a substantially water tight interface between the wall panel 816*b* and the beam 108. In some examples, the location and arrangement of components of the waterproofing assembly 890-2 may be reversed. That is, the elongate member 892 may be attached to the perimeter side of the wall panel 816*b* and the sealing member 894 may be attached to the lower surface of the elongate member 892, such that when the wall panel 816*b* is placed over the beam 108, the sealing member 894 is provided against and compressed by a surface of the beam 108. Waterproofing assemblies in accordance with the examples herein may substantially obviate the need for using conventional metal flashings and may advantageously further function to thermally isolate hot and cold metal components.

Figure 11:
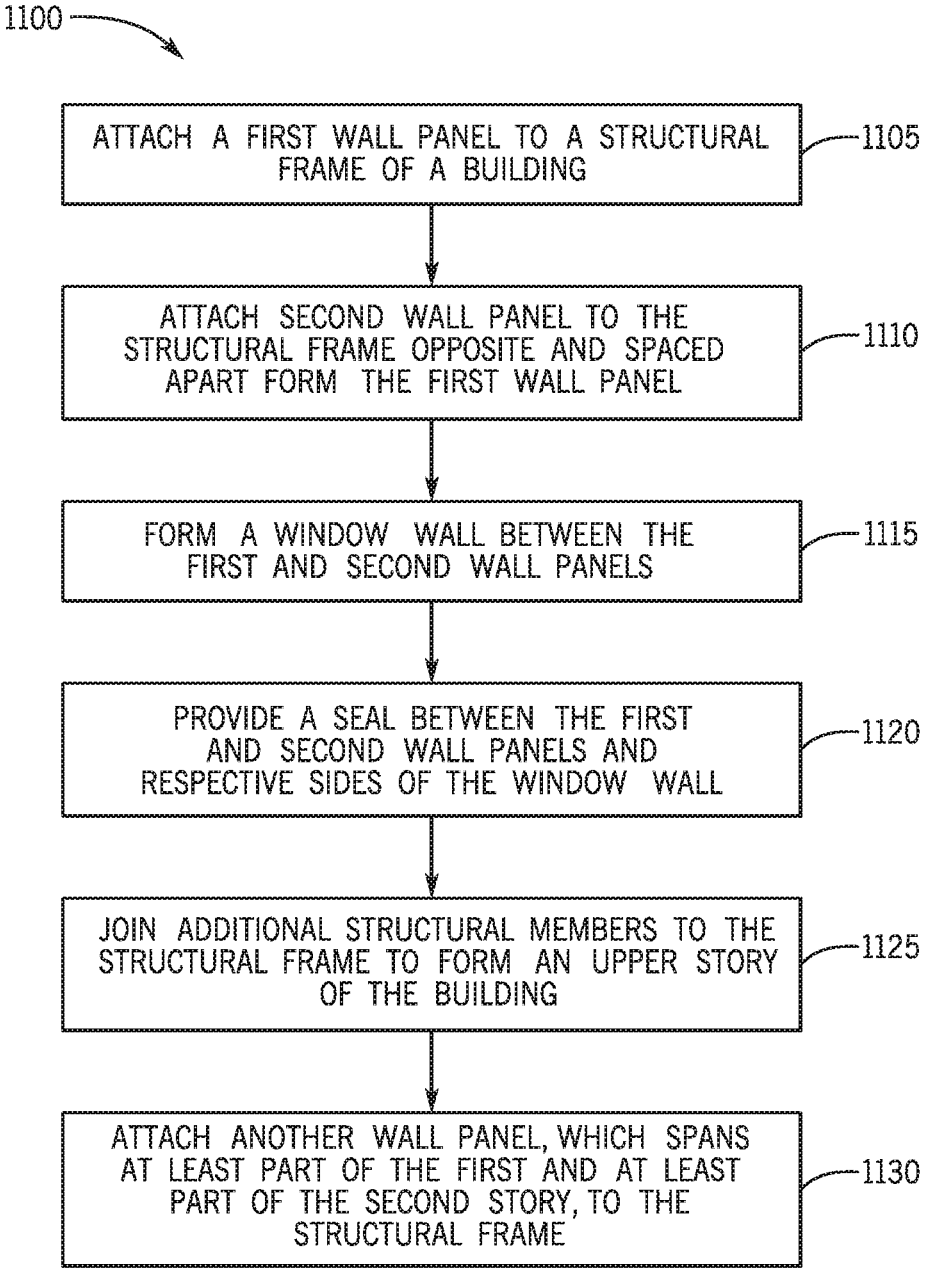
FIG. 11 is a flow diagram of an example method in accordance with the present disclosure.

FIG. 11 is a flow diagram of an example method in accordance with the present disclosure. The method 1100 may be used to construct a wall system for a building, such as building 102. An example method may include one or more operations, functions or actions as illustrated by one or more of blocks 1105-1125. The various blocks shown in FIG. 11 are merely illustrative, and other variations, including eliminating, combining, and substituting blocks are all contemplated.

An example method 1100 may include attaching a first pre-assembled wall panel to a structural frame of a building, as shown in block 1105. A wall panel may be attached directly to the structural frame, such as with components that mount the panel to the frame, or indirectly attached to the structural frame, such as through attachment of the wall panel to other components (e.g., to a floor-ceiling panel). The structural frame may include a first beam and a second beam opposite and spaced apart from the first beam. The first pre-assembled wall panel may be disposed at least partially over the first beam. The method 1100 may include attaching a second pre-assembled wall panel to the structural frame, as shown in block 1110. The second pre-assembled wall panel may be attached opposite and spaced apart from the first pre-assembled wall panel. The second pre-assembled wall panel may be disposed at least partially over the second beam. In some examples, each of the first and second pre-assembled wall panels may include at least one non-metallic waterproofing assembly along a perimeter side of respective one of the first or second pre-assembled wall panels.

In some examples, each of the first and second pre-assembled wall panels may extend a full length of a unit of the building. In some examples, the first pre-assembled wall panel may include a first waterproofing assembly extending along a first vertical side, a second waterproofing assembly extending along a second vertical side opposite the first vertical side, and a third waterproofing assembly extending along a horizontal side between the first and second vertical sides. In some examples, each of the first and second pre-assembled wall panels may include a waterproofing assembly extending along respective vertical perimeter sides. In some examples, the method 1100 may include forming a window wall between the first and second pre-assembled wall panels. The method 1100 may further include providing a seal between the first and second pre-assembled wall panels and respective sides of the window wall, such as providing a non-structural seal between the waterproofing assemblies of each of the first and second pre-assembled wall panels and respective sides of the window wall.

In some examples, the first pre-assembled wall panel may define an exterior wall of a building and the second pre-assembled wall panel may define an interior wall of the building. In such examples, the method may further include joining an additional pre-assembled wall panel to the structural frame spaced from the second pre-assembled wall panel on an opposite side from the first pre-assembled wall panel. The additional pre-assembled wall panel may define another exterior wall of the building.

One or more of the steps in blocks 1105, 1110, 1115, and 1120 as well as additional steps may be involved in forming one story of a building, such as a lower story of the building. After the lower story has been completed or partially completed, the method may further include forming an upper story of the building. In some examples, the method 1100 may include joining additional structural members to the structural frame to form the upper story of the building, as shown in block 1125. The method 1100 may further include attaching an additional pre-assembled wall panel to the structural frame and the first pre-assembled wall panel, which spans at least part of the lower and part of the upper story of the building, as shown in block 1130. In some examples, attaching the additional pre-assembled wall panel that spans at least part of the lower and upper stories may include positioning the additional pre-assembled wall panel perpendicular to the first pre-assembled wall panel and pushing the additional pre-assembled wall panel towards the first pre-assembled wall panel to cause interlocking features of a gasket to engage respective interlocking features of respective waterproofing assemblies of the first and the additional pre-assembled wall panels.

In further examples, the additional pre-assembled wall panel that spans at least part of the lower and upper stories may be a first utility wall panel. In such examples, the method may further include joining a second utility wall panel to the first utility wall panel, each of the first and second utility wall panels including a first waterproofing assembly along a first vertical perimeter side and a second waterproofing assembly along a second opposite vertical perimeter side of respective ones of the first and second utility wall panels, each of the first and second waterproofing assemblies including an insert configured to interlock with a gasket positioned between the first and second utility wall panels. In some examples, the first utility wall panel may be joined to the second utility wall panel before joining the utility wall panels to the first pre-assembled wall panel.

Figure 12:
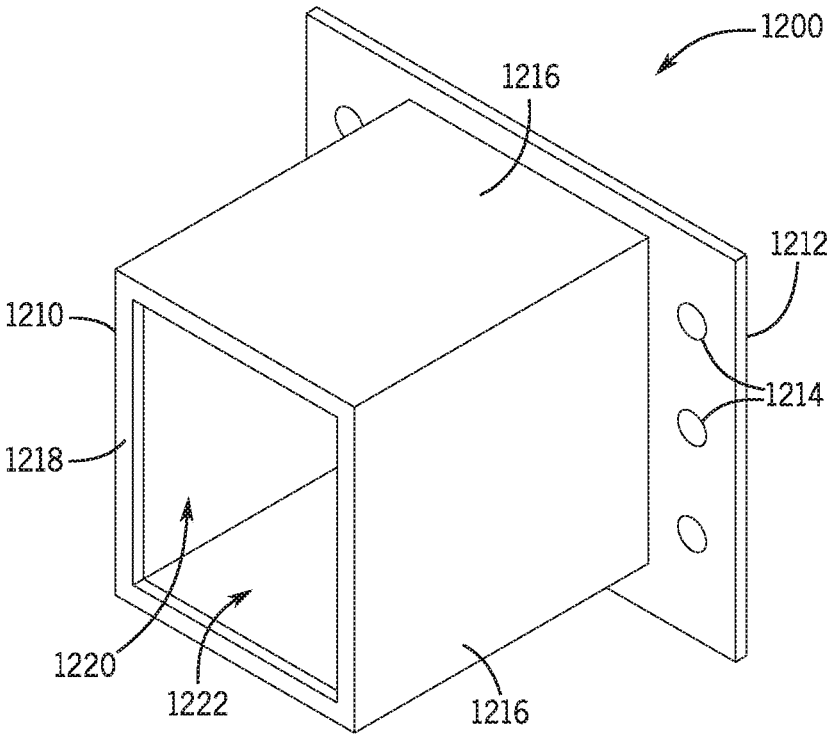
FIG. 12 is an isometric view of an example insulating member in accordance with some examples of the present disclosure.
Figure 13:
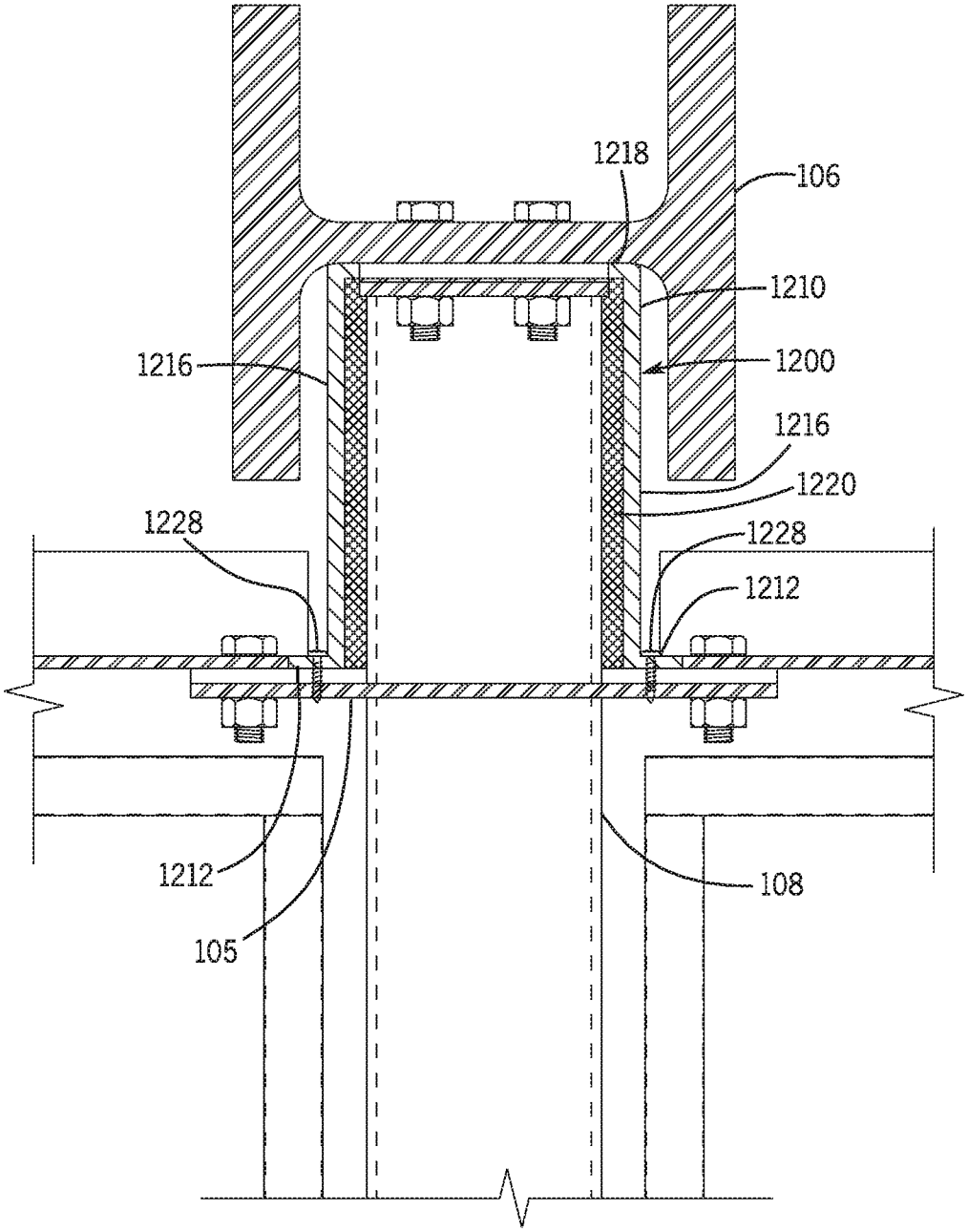
FIG. 13 is a cross-sectional view of the example insulating member in FIG. 12 attached to a structural member of a building such as building 102.

FIGS. 12 and 13 show an isometric view and a cross-sectional view of an example insulating member in accordance with some examples of the present disclosure. FIG. 12 shows insulating member 1200, body 1210, flange 1212, holes 1214, walls 1216, rim portion 1218, cavity 1222, and thermally insulative material 1220. FIG. 13 shows column 106, beam 108, collar 105, insulating member 1200, body 1210, flange 1212, walls 1216, rim portion 1218, thermally insulative material 1220, and fasteners 1228. The various components shown in FIGS. 12 and 13 are merely illustrative, and other variations, including eliminating components, combining components, and substituting components are all contemplated.

The insulating member 1200 may be attached to a structural member of a building such as building 102 and may function as a thermal isolator to reduce the transfer of thermal energy between adjoining metal components. The insulating member 1200 may be shaped for a cooperating fit over an end of a structural member, such as beam 108. The insulating member 1200 may be formed of virtually any non-thermally conductive material, such as plastic, FRP or another type of composite material. In some examples, the insulating member 1200 may be formed as a cast or molded FRP component. The insulating member 1200 may include a generally box-shaped body 1210 defined by walls 1216. A flange 1212 may extend generally perpendicularly to the walls 1216 from one end of the body 1210. The flange 1212 may include fastener holes 1214 for attaching the insulating member 1200 to the structural frame. The body 1210 may be hollow defining a cavity 1222 which is sized to receive the end of beam 108. Thermally insulative material 1220 may be provided inside the cavity 1222. For example, the interior sides of the walls 1216 may be lined with mineral wool. The end of the body 1210 opposite the flange 1212 may include a rim portion 1218 which may correspond in width to the thickness of the insulative material. In some examples, the rim portion 1218 may be wider than the insulative material and may extend partially over the front face of beam 108. When attached to the building, the insulating member 1200 may be positioned over the end of beam 108 between the beam 108 and column 106. The insulating member 1200 may be attached to the structure, such as to a collar 105 coupled to beam 108 via fasteners 1228 passing through the flange 1212. The insulating member 1200 may be attached between one or more structural members of a building such as building 102 and may function as a thermal isolator to reduce the transfer of thermal energy between adjoining metal components.

The examples provided are for explanatory purposes only and should not be considered to limit the scope of the disclosure. Embodiments of pre-assembled components, such as the wall panels 116, may provide a wall system useable in low-rise, mid-rise, and high-rise residential projects, among others. The wall panels may be configured to comply with one or more of the following building codes: fire, energy, handicap, life-safety, and acoustical (impact and ambient noise transfer). In some embodiments, the pre-assembled wall panels may be considered as a fully-integrated sub-assembly meeting fire, sound impact, energy, and life/safety codes. The floor and ceiling panels may be fully integrated with electrical, fire protection, energy insulation, and sound isolation capabilities in some embodiments. The floor and ceiling panels may be designed to achieve a fire rating set by the applicable building code, such as a two-hour fire rating. In some embodiments, the panels may provide a heating system for the building units, such as the units 112 in FIG. 1.

The wall panels described herein may be fabricated off-site in a factory or shop and transported to the project site (also referred to as job site) for attachment to a structural frame, such as a structural exoskeleton, of a building. The panels may be fabricated in various sizes. For example, a panel according to the present disclosure may have a length of about 20 feet or more (e.g., 22 feet, 24 feet, 26 feet) and a height from about 8 feet to about 9 feet. In some examples, the panels may be shorter or longer in height (e.g., 7 feet, 7½ feet, 9 feet, 9½ feet, or other). These length and height dimensions may generally exclude components that extend beyond the perimeter of the panel, e.g., as may be used to join adjacent panels and/or join the panels to the structural frame. That is, in some examples, an overall length of a panel may exceed 24 and a height of the panel may exceed 9 feet in height although the panel may be referred to as a 24 by 9 foot panel. Generally, any size panels, including larger panels and smaller infill panels than the examples above may be fabricated on a project-by-project need to complete the building floor system. At the building site, the panel may be attached to end walls, demising walls, utility walls, building utilities, or any combination thereof.

The present disclosure is not to be limited in terms of the particular embodiments described in this application, which are intended as illustrations of various aspects. Many modifications and embodiments can be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. Such modifications and embodiments are intended to fall within the scope of the appended claims. The present disclosure includes the terms of the appended claims, along with the full scope of equivalents to which such claims are entitled. It is to be understood that this disclosure is not limited to particular methods, reagents, compounds compositions or biological systems, which can, of course, vary. It is also to be understood that the terminology used herein is for the purpose of describing particular embodiments only, and is not intended to be limiting.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.).

It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations).

Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

In addition, where features or aspects of the disclosure are described in terms of Markush groups, those skilled in the art will recognize that the disclosure is also thereby described in terms of any individual member or subgroup of members of the Markush group.

As will be understood by one skilled in the art, for any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," and the like include the number recited and refer to ranges which can be subsequently broken down into subranges as discussed above. Finally, as will be understood by one skilled in the art, a range includes each individual member. Thus, for example, a group having 1-3 items refers to groups having 1, 2, or 3 items. Similarly, a group having 1-5 items refers to groups having 1, 2, 3, 4, or 5 items, and so forth.

While the foregoing detailed description has set forth various embodiments of the devices and/or processes via the use of block diagrams, flowcharts, and/or embodiments, such block diagrams, flowcharts, and/or embodiments contain one or more functions and/or operations, it will be understood by those within the art that each function and/or operation within such block diagrams, flowcharts, or embodiments can be implemented, individually and/or collectively, by a wide range of hardware, software, firmware, or virtually any combination thereof.

The herein described subject matter sometimes illustrates different components contained within, or connected with, different other components. It is to be understood that such depicted architectures are merely examples, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality, and any two components capable of being so associated can also be viewed as being "operably couplable", to each other to achieve the desired functionality. Specific embodiments of operably couplable include but are not limited to physically mateable and/or physically interacting components and/or wirelessly interactable and/or wirelessly interacting components and/or logically interacting and/or logically interactable components.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A pre-assembled wall panel, comprising:

a panel frame including a perimeter member that defines a perimeter side of the panel frame;

first and second wall boards attached to opposite sides of the panel frame to define first and second major sides of the wall panel, wherein each of the first and second wall boards comprise non-combustible material; and a waterproofing assembly that encloses the perimeter side of the panel frame and that extends along a full length of the perimeter side, wherein the waterproofing assembly includes a non-metallic elongate member comprising first and second opposing flanges disposed against respective exterior surfaces of the first and second wall boards, wherein the first and second opposing flanges are attached to the perimeter member, and wherein the waterproofing assembly includes at least one aperture coupled to at least one duct of the wall panel.

2. The building of claim 1, wherein the waterproofing assembly comprises an elongate member formed of a fiber reinforced plastic (FRP).

3. The wall panel of claim 1, wherein the waterproofing assembly comprises a first waterproofing assembly that extends along a first perimeter side of the panel frame, and wherein the wall panel further comprises a second waterproofing assembly proximate a second opposite perimeter side of the panel frame.

4. The wall panel of claim 3, wherein the first waterproofing assembly has an overall width substantially corresponding to a distance between the exterior surfaces of the first and second wall boards, and wherein the second waterproofing assembly has an overall width greater than the distance between the exterior surfaces of the first and second wall boards.

5. The wall panel of claim 3, wherein the first waterproofing assembly includes a first elongate member and a second elongate member movably received within a cavity defined by the first elongate member, and wherein the second elongate member is configured to removably engage a sealing member.

6. The wall panel of claim 5, wherein at least one of the first elongate member and the second elongate member comprises an FRP pultrusion, and wherein the sealing member is formed of a resilient material.

7. The wall panel of claim 3, wherein each of the first and second waterproofing assemblies includes a first elongate member and a second elongate member movably received within a cavity defined by the first elongate member, and wherein the wall panel further comprises a sealing member coupled to the second elongate member of one of the first waterproofing assembly or the second waterproofing assembly.

8. The wall panel of claim 7, wherein an opening of the cavity of the first waterproofing assembly is perpendicular to an opening of the cavity of the second waterproofing assembly.

9. The wall panel of claim 1, wherein the waterproofing assembly comprises an elongate member having a first wall opposite and spaced from a perimeter member of the panel frame and second and third walls adjacent to the first wall and defining a cavity therebetween, and wherein the waterproofing assembly further comprises insulative material along at least two of the first, second, and third walls.

10. The wall panel of claim 1, further comprising another waterproofing assembly that extends perpendicularly to the waterproofing assembly.

11. The wall panel of claim 1, wherein the waterproofing assembly is present along only the perimeter side of the wall panel.

12. The wall panel of claim 1, wherein the waterproofing assembly includes an elongate member comprising a wall that separates an interior of the elongate member into at least a first cavity and a second cavity, and wherein each of the cavities is connected to a respective duct provided on respective sides of the wall panel.

13. The wall panel of claim 1, wherein the waterproofing assembly is formed of two elongate members positioned on opposite sides of the wall panel and that abut one another, and wherein each of two elongate members is fluidly connected to a duct attached to the wall panel.

14. A multi-story building, comprising:

a structural frame including a first horizontal beam associated with a lower story of the building and a second horizontal beam associated with an upper story of the building; and a pre-assembled wall panel attached to the structural frame between the first and second horizontal beams, wherein the wall panel comprises a panel frame and wall boards attached to opposite sides of the panel frame, wherein the wall panel further comprises a non-metallic waterproofing assembly that extends along a vertical perimeter side of the panel frame, wherein the waterproofing assembly encloses the vertical perimeter side and a vertical edge of each of the wall boards, and wherein the waterproofing assembly includes at least one aperture coupled to at least one duct of the wall panel.

15. The building of claim 14, wherein the pre-assembled wall panel spans a full height of the lower story and a full length of a lower story unit of the building.

16. The building of claim 14, wherein the waterproofing assembly comprises an elongate member formed of a fiber reinforced plastic (FRP).

17. The building of claim 16, wherein the elongate member comprises a FRP pultrusion.

18. The building of claim 16, wherein the waterproofing assembly further comprises thermally insulative material along internal cavity walls of the elongate member.

19. The building of claim 14, wherein the waterproofing assembly is configured to engage a gasket formed of a resilient material.

20. The building of claim 19, wherein the waterproofing assembly comprises a first FRP component that defines a cavity and a second FRP component that is received at least partially within the cavity, and wherein the second FRP component is configured to interlock with the gasket.

21. The building of claim 14, wherein the waterproofing assembly comprises a first waterproofing assembly, and wherein the wall panel further comprises at least one additional second waterproofing assembly along an adjacent or opposite side of the wall panel.

22. The building of claim 14, wherein the pre-assembled wall panel comprises a first pre-assembled wall panel, wherein the building further comprises a second pre-assembled wall panel disposed over the second horizontal beam and that spans a full height of the upper story and a full length of an upper story unit of the building, and wherein the second pre-assembled wall panel comprises at least one non-metallic waterproofing assembly that spans a length or a height of the second pre-assembled wall panel.

23. The building of claim 14, further comprising another pre-assembled wall panel which spans at least part of a height of the lower story and part of a height of the upper story of the building.

24. The building of claim 14, further comprising another non-metallic waterproofing assembly that covers, at least in part, an end of at least one beam of the first and second horizontal beams, and wherein the another waterproofing assembly is disposed between the at least one beam and a column attached to the at least one beam.

25. The building of claim 24, wherein the another waterproofing assembly is separable from the at least one beam and includes thermally insulative material on an interior side of the another waterproofing assembly.

26. A method to construct a wall system for a building, the method comprising:

attaching a first pre-assembled wall panel to a structural frame of a building, wherein the structural frame includes a first beam and a second beam opposite and spaced apart from the first beam, and wherein the first pre-assembled wall panel is disposed at least partially over the first beam; and attaching a second pre-assembled wall panel to the structural frame opposite and spaced apart from the first pre-assembled wall panel, the second pre-assembled wall panel disposed at least partially over the second beam, wherein each of the first and second pre-assembled wall panels includes at least one non-metallic waterproofing assembly along a perimeter side of a respective one of the first or second pre-assembled wall panels, and wherein the at least one non-metallic waterproofing assembly includes at least one aperture coupled to at least one duct of the respective one of the first or second pre-assembled wall panels.

27. The method of claim 26, wherein each of the first and second pre-assembled wall panels extends a full length of a unit of the building.

28. The method of claim 26, wherein the first pre-assembled wall panel includes a first waterproofing assembly that extends along a first vertical side, a second waterproofing assembly that extends along a second vertical side opposite the first vertical side, and a third waterproofing assembly that extends along a horizontal side between the first and second vertical sides.

29. The method of claim 26, wherein each of the first and second pre-assembled wall panels includes a waterproofing assembly that extends along respective vertical perimeter sides, and wherein the method further comprises:

forming a window wall between the first and second pre-assembled wall panels; and providing a non-structural seal between the waterproofing assemblies of each of the first and second pre-assembled wall panels and respective sides of the window wall.

30. The method of claim 26, wherein the first pre-assembled wall panel defines an exterior wall of a building, wherein the second pre-assembled wall panel defines an interior wall of the building, wherein the method further comprises joining another pre-assembled wall panel to the structural frame spaced from the second pre-assembled wall panel on an opposite side from the first pre-assembled wall panel, and wherein the another pre-assembled wall panel defines another exterior wall of the building.

31. The method of claim 26, further comprising:

forming a lower story of a building;

joining additional structural members to the structural frame to form an upper story of the building; and attaching an additional pre-assembled wall panel to the structural frame and the first pre-assembled wall panel, wherein the additional pre-assembled wall panel spans at least part of the lower and part of the upper story of the building.

32. The method of claim 31, wherein the attaching the additional pre-assembled wall panel includes positioning the additional pre-assembled wall panel perpendicular to the first pre-assembled wall panel and pushing the additional pre-assembled wall panel towards the first pre-assembled wall panel to cause interlocking features of a gasket to engage respective interlocking features of respective waterproofing assemblies of the first and additional pre-assembled wall panels.

33. The method of claim 32, wherein the additional pre-assembled wall panel comprises a first utility wall panel, wherein the method further comprises joining a second utility wall panel to the first utility wall panel, wherein each of the first and second utility wall panels comprises a first waterproofing assembly along a first vertical perimeter side and a second waterproofing assembly along a second opposite vertical perimeter side of respective ones of the first and second utility wall panels, and wherein each of the first and second waterproofing assemblies comprises an insert configured to interlock with a gasket positioned between the first and second utility wall panels.

34. The method of claim 33, wherein the first utility wall panel is joined to the second utility wall panel before joining the first and second utility wall panels to the first pre-assembled wall panel.

* * * * *